US006648941B2

(12) United States Patent
Uenosono et al.

(10) Patent No.: US 6,648,941 B2
(45) Date of Patent: Nov. 18, 2003

(54) IRON-BASED MIXED POWDER FOR POWDER METALLURGY AND IRON-BASED SINTERED COMPACT

(75) Inventors: Satoshi Uenosono, Chiba (JP); Junichi Ohta, Chiba (JP); Akio Sonobe, Chiba (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 10/080,234

(22) Filed: Feb. 21, 2002

(65) Prior Publication Data

US 2003/0075016 A1 Apr. 24, 2003

(30) Foreign Application Priority Data

May 17, 2001 (JP) ..... 2001-148513
Aug. 29, 2001 (JP) ..... 2001-259470
Jan. 31, 2002 (JP) ..... 2002-024391

(51) Int. Cl.[7] ..... B22F 1/00
(52) U.S. Cl. ..... 75/252
(58) Field of Search ..... 75/252

(56) References Cited

U.S. PATENT DOCUMENTS 4,415,363 A * 11/1983 Sanftleben et al. ..... 75/229
4,663,060 A * 5/1987 Holinski ..... 252/12
4,834,800 A * 5/1989 Semel ..... 106/403
5,135,566 A * 8/1992 Sakuranda et al. ..... 75/255
5,279,640 A * 1/1994 Ogura et al. ..... 75/343
5,432,223 A * 7/1995 Champagne et al. ..... 524/431
5,631,431 A * 5/1997 Andersson ..... 75/230
5,744,433 A * 4/1998 Storstrom et al. ..... 508/454

FOREIGN PATENT DOCUMENTS

WO WO 98/12448 * 3/1998

* cited by examiner

*Primary Examiner*—Ngoclan Mai
(74) *Attorney, Agent, or Firm*—Piper Rudnick LLP

(57) ABSTRACT

In order to improve machinability of a sintered compact, a phosphate compound of an alkali earth metal (calcium phosphate compound or the like) is mixed with an iron-based powder, or an alkali earth metal fluoride (calcium fluoride, or the like) is further mixed with the iron-based powder. Alternatively, the alkali earth metal fluoride, together with a graphite powder, is preferably fixed to recesses of the iron-based powder.

20 Claims, 3 Drawing Sheets

IRON-BASED MIXED POWDER FOR POWDER METALLURGY AND IRON-BASED SINTERED COMPACT

BACKGROUND OF THE INVENTION

1. Field of the Invention

This invention relates to an iron-based mixed powder for powder metallurgy. More particularly, this invention is suitable for obtaining a sintered compact having excellent machinability, but is not limited to this application.

2. Description of the Related Art

Progress in powder metallurgical techniques has enabled the production of parts having complicated shapes and high dimensional precision near to "net shape" (requiring substantially no machining for obtaining a target shape). An iron-based powder metallurgical product is generally produced by mixing an iron-based powder, a powder for an alloy such as a copper powder, a graphite powder, or the like, and a lubricant such as zinc stearate, lithium stearate or the like to form an iron-based mixed powder for powder metallurgy, filling a die(mold) with the resultant mixed powder, pressing the mixture under pressure, sintering the green compact to form a sintered compact and, if required, machining the product. The thus-produced sintered compact has a high content of voids and, thus, has higher cutting force than metallic materials obtained by a solution process. Therefore, to improve the machinability of the sintered compact, any one of various powders of Pb, Se, Te, S, MnS, BaS, CaS, and the like or an alloy thereof is conventionally added to the iron-based mixed powder.

However, Pb has a melting point as low as 330° C. and, thus, has the problem that it is melted in the sintering process and is not dissolved in iron, thereby causing difficulties in homogeneous dispersing Pb in a base matrix. Se and Te embrittle the sintered compact and, thus, have the problem of significantly deteriorating the mechanical properties of the sintered compact.

Japanese Examined Patent Publication No. 46-39564 discloses a free-cutting metallic material produced by a powder metallurgical method in which $BaSO_4$ or BaS is added to iron or an iron-based alloy singly or in a mixture. This publication also discloses that the method improves machinability by adding $BaSO_4$ or BaS singly or in a mixture. Japanese Examined Patent Publication No. 52-16684 discloses a method of producing sintered steel with excellent machinability in which a mixed powder obtained by adding calcium sulfide CaS or calcium sulfate $CaSO_4$ to an iron-based raw material powder is pressed and then sintered.

However, mixing with S or a S-containing compound such as MnS or the like as a machinability improving powder causes the problem of contaminating the refractory of the sintering furnace, the conveyor mesh belt, heating device, etc. with $H_2S$ produced in sintering, thereby decreasing the lifetime of these parts. In addition, there is also the problem of deteriorating the appearance of the sintered compact. Therefore, mixing a S-containing compound as a machinability improving powder with the iron-based mixed powder is avoided. Furthermore, when BaS, CaS, or the like remains in the sintered compact, the sintered compact has the problem in which corrosion easily occurs due to hygroscopicity of BaS and CaS.

For these problems, for example, Japanese Unexamined Patent Publication No. 57-198201 discloses a steel powder for sintering which contains 0.001 to 0.10% of Ca and 0.05 to 1.0% of O and which provides a sintered compact having good machinability. The sintered compact produced by using the sintering powder disclosed in Japanese Unexamined Patent Publication No. 57-198201 does not have the problem of contaminating the sintering furnace because S is not contained, but the sintered compact has the problem of deteriorating fluidity of the powder and destabilizing pressing because calcium oxide has hygroscopicity.

Japanese Unexamined Patent Publication No. 7-507358 discloses an iron-based powder composition containing 0.1 to 0.6% by weight of calcium fluoride $CaF_2$ and having improved machinability. However, according to the findings obtained in research conducted by the inventors, the method of simply mixing calcium fluoride in a free state as disclosed in this publication cannot satisfactorily improve machinability. Furthermore, impurities contained in calcium fluoride $CaF_2$ might affect the dimensional changes and mechanical properties of the sintered compact. Therefore, this method is preferably carried out with caution, such as using high-purity calcium fluoride.

Japanese Unexamined Patent Publication No.9-279204 discloses an iron-based mixed powder for powder metallurgy which contains 0.02 to 0.3% by weight of $CaO—Al_2O_3—SiO_2$ system compound oxide powder mainly comprising an iron powder and having an anorthite phase and/or gehlenite phase and an average particle diameter of 50 $\mu$m or less. However, unless the $CaO—Al_2O_3—SiO_2$ system compound oxide powder containing fewer impurities and having a limited particle size is used, there is the problem of deteriorating the properties of the powder and the sintered compact.

Japanese Unexamined Patent Publication No. 63-137137 discloses a method of producing sintered steel in which a graphite powder comprising an alkali earth fluoride in an amount corresponding to 0.1 to 1.2% by weight of a raw material iron powder, the alkali earth fluoride being partially or entirely adhered to the surfaces of the graphite powder, is added to the raw material iron powder, and the resultant mixture is sintered. This publication also discloses that the sintered steel produced by the method has excellent machinability. However, the technique disclosed in Japanese Unexamined Patent Publication No. 63-137137 must use an alkali earth fluoride ground to a small particle size of about 1/10 of the particle size of the graphite powder, thereby causing the problem of adding the step of grinding the alkali earth fluoride as a separate step and significantly increasing the production cost.

It would accordingly be advantageous to solve the above problems of conventional techniques and to provide an iron-based mixed powder capable of improving machinability of a sintered compact without deteriorating the mechanical properties of the sintered compact and a sintering furnace.

SUMMARY OF THE INVENTION

We intensively studied machinability improving powders capable of improving machinability without deteriorating the mechanical properties of a sintered compact. As a result, it was found that a phosphate compound of an alkali earth metal, particularly, calcium phosphate compound is effective. As a result of further experiment and research based on that finding, this invention was achieved.

In accordance with a first aspect of the invention, an iron-based mixed powder for powder metallurgy comprises an iron-based powder, an alloy powder (a powder for an alloy), a machinability improving powder, and a lubricant, wherein the machinability improving powder contains a phosphate compound of an alkali earth metal.

The invention also provides an iron-based sintered compact obtained by pressing the iron-based mixed powder of the invention resulting in a green compact, and then sintering the green compact.

The phosphate compound of an alkali earth metal comprises preferably calcium phosphate compound, and more preferably hydroxyapatite. The machinability improving powder preferably substantially consists of calcium phosphate compound (more preferably, hydroxyapatite) with substantially no additive intentionally added. The hydroxyapatite preferably comprises crystallites of over about 200 Å, preferably over about 600 Å.

In the first aspect of the invention, the machinability improving powder preferably further comprises an alkali earth fluoride, preferably calcium fluoride. In this case, the machinability improving powder preferably comprises calcium phosphate compound and calcium fluoride, and more preferably comprises hydroxyapatite preferably comprising crystallites of over about 200 Å, more preferably over about 600 Å, and calcium fluoride. In this case, the machinability improving powder preferably comprises calcium fluoride and calcium phosphate compound at a ratio (content of calcium fluoride)/(content of calcium phosphate compound) of about 0.8 or more in terms of Ca.

The machinability improving powder more preferably substantially consists of calcium phosphate compound and calcium fluoride, or hydroxyapatite comprising crystallites of over about 200 Å, preferably over about 600 Å, and calcium fluoride, with substantially no additive intentionally added.

Particularly, when a compound containing Ca is mainly used for the machinability improving powder, the machinability improving powder is preferably contained in a total amount of about 0.02 to about 0.39% by mass in terms of Ca based on the total amount of the iron-based powder, for the alloy powder and the machinability improving powder.

In the first aspect of the invention, calcium phosphate compound is preferably at least one selected from tricalcium phosphate, calcium monohydrogen phosphate, calcium dihydrogen phosphate, and hydroxyapatite.

In the first aspect of the invention, the content of the alloy powder is preferably about 5% by mass or less based on the total amount of the iron-based powder, the alloy powder and the machinability improving powder.

In the first aspect of the invention, the content of the lubricant is preferably about 0.2 to about 1.5 parts by weight based on the total amount of 100 parts by weight of the iron-based powder, the alloy powder and the machinability improving powder.

In the first aspect of the invention, the alloy powder and/or the machinability improving powder is preferably adhered to the surfaces of a part or the whole of the iron-based powder.

We intensively studied the influences of various factors on the machinability of the sintered compact. As a result, we arrived at the conclusion that from the viewpoint of improving the appearance of the sintered compact and prevention of contamination of the sintering furnace, an alkali earth metal fluoride powder (i.e., powdered) is also effective as the machinability improving powder. We further found that by using the alkali earth metal fluoride powder as the machinability improving powder, the machinability of the sintered compact is significantly improved by fixing the machinability improving powder, together with a graphite powder, to the surfaces of the iron-based powder with a binder. This is because when the iron-based mixed powder comprising the graphite powder and the machinability improving powder, which are fixed to the surfaces thereof, is pressed and then sintered to form the sintered compact, the graphite powder and the alkali earth metal fluoride powder can be put into direct contact with each other in a so-called "dewaxed" state in which the lubricant and the binder are substantially evaporated in the sintering process, thereby significantly improving the machinability of the sintered compact.

In a second aspect of the invention, an iron-based mixed powder for powder metallurgy comprises an iron-based powder, an alloy powder including a graphite powder, a machinability improving powder, a binder, and a lubricant, wherein the machinability improving powder contains an alkali earth metal fluoride powder, and the graphite powder and the alkali earth metal fluoride powder are fixed to the surfaces of the iron-based powder, preferably to concave portion on the surface of the iron-based powder, with the binder.

The invention also provides an iron-based sintered compact obtained by pressing the above iron-based mixed powder resulting in a green compact, and then sintering the green compact.

In the invention, the machinability improving powder more preferably substantially consists of the alkali earth metal fluoride powder with substantially no additive intentionally added.

The alkali earth metal fluoride powder preferably comprises at least one of calcium fluoride, magnesium fluoride, strontium fluoride, and barium fluoride.

In the second aspect of the invention, the machinability improving powder is preferably contained at a content of about 0.1 to about 0.7% by mass based on the total amount of the iron-based powder, the alloy powder, and the machinability improving powder.

In the second aspect of the invention, the lubricant is preferably a free lubricant in a free state.

In the invention, the content of the alloy powder is preferably about 0.5 to about 7% by mass based on the total amount of the iron-based powder, the alloy powder, and the machinability improving powder. In the invention, the alloy powder preferably comprises a graphite powder or further comprises a metal powder and/or an alloyed metal powder. The content of the graphite powder is preferably about 0.5 to about 7% by mass, and more preferably about 0.5 to about 5% by mass, based on the total amount of the iron-based powder, the alloy powder, and the machinability improving powder.

In the invention, the content of the lubricant is preferably about 0.1 to about 0.5 part by mass based on the total amount of 100 parts by weight of the iron-based powder, the alloy powder, and the machinability improving powder.

In the invention, the content of the binder is preferably about 0.1 to about 1.0 part by mass based on the total amount of 100 parts by mass of the iron-based powder, the alloy powder, and the machinability improving powder.

DETAILED DESCRIPTION

Figure 1:
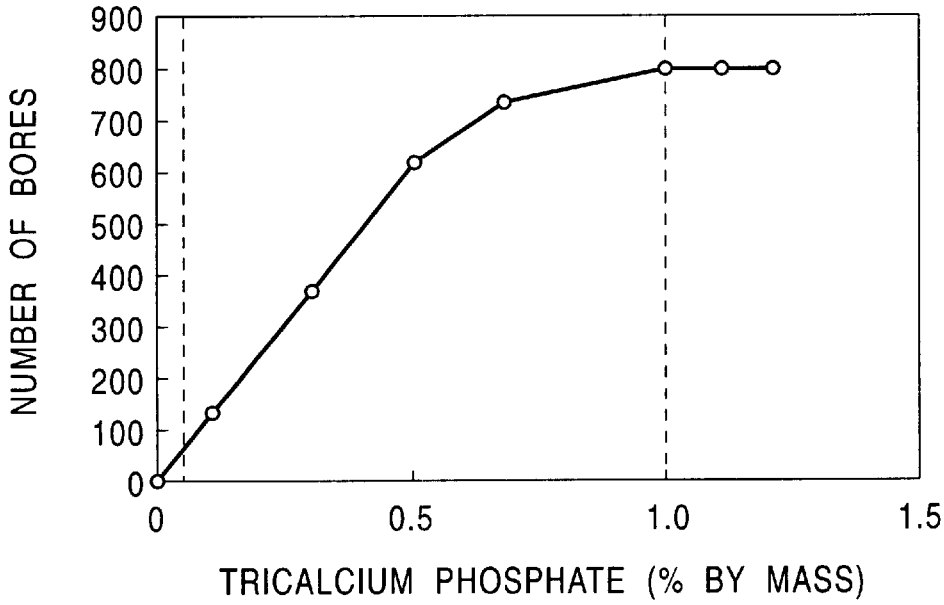
FIG. 1 is a graph showing the relationship between the number of bores and the content of tricalcium phosphate in a drilling test.

A first embodiment of the invention will be described below.

In the description below, for particles which form agglomerated particles described below, the average particle diameter represents the average diameter of the agglomerated particles unless otherwise specified.

First, the results of the fundamental experiment we performed will be described below.

A water-atomized pure iron powder (KIP®301A, produced by Kawasaki Steel Corporation and having an average particle diameter of 75 μm) was prepared as an iron-based powder. A natural graphite powder having an average particle diameter of 4 μm and used as an alloy power, zinc stearate as a lubricant (average particle diameter 20 μm), and a tricalcium phosphate powder ($Ca_3(PO_4)_2$, average particle diameter 18 μm) as a machinability improving powder were put in a blender together with the water-atomized pure iron powder, and then uniformly mixed therein to obtain an iron-based mixed powder. The amounts of the graphite powder and the machinability improving powder were 0.7% by mass and O to 1.2% by mass, respectively, based on the total amount of the iron-based powder, the alloy powder and the machinability improving powder. The amount of the lubricant mixed was 0.75 part by weight based on the total amount of 100 parts by weight of the iron-based powder, the alloy powder and the machinability improving powder.

The contents of the atomized pure iron powder used included 0.001% by mass of C, 0.01% by mass of Si, 0.12% by mass of Mn, 0.013% by mass of P, 0.004% by mass of S, and 0.12% by mass of O (the balance composed of iron and other inevitable impurities).

Then, a die(mold) was filled with the iron-based mixed powder, and pressing was carried out so that the green density was 6.6 $Mg/m^3$ to form a radial crushing test specimen ring of outer diameter 35 mm×inner diameter 14 mm×height 10 mm, and a drilling test specimen of outer diameter 60 mm×height 10 mm. Then, these specimens were sintered at 1130° C. for 20 min. in an atmosphere of RX gas (32% $H_2$-24% CO-0.3% $CO_2$-balance $N_2$; % by volume) by using a mesh belt furnace.

These sintered specimens were subjected to a radial crushing test according to JIS Z 2507 and a drilling test under the conditions of a revolution speed of 10000 rpm and a feed of 0.012 mm/rev to characterize crushing strength and the machinability. The number of bores formed until a drill (made of high speed steel, 1.2 mmø) was chipped was used as an index of the machinability. The results are shown in FIGS. 1 and 2.

Figure 2:
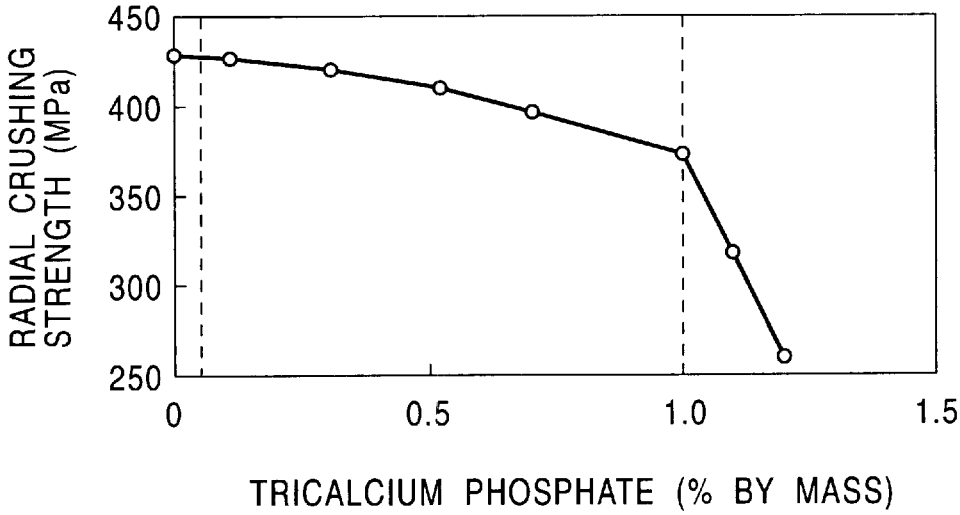
FIG. 2 is a graph showing the relationship between radial crushing strength and the content of tricalcium phosphate in a radial crushing test.

FIG. 1 indicates that the number of bores substantially linearly increases as the content of the tricalcium phosphate powder in the iron-based mixed powder increases. On the other hand, the number of bores is saturated when the content of the tricalcium phosphate powder in the iron-based mixed powder is 1.0% by mass or more. FIG. 2 indicates that radial crushing strength decreases when the content of the tricalcium phosphate powder in the iron-based mixed powder exceeds 1.0% by mass. It is thus found that by containing 0.05 to 1.0% by mass of tricalcium phosphate powder in the iron-based mixed powder, both excellent machinability and high crushing strength can be obtained.

We also found that hydroxyapatite can improve machinability without deteriorating the mechanical properties of the sintered compacts.

We further found that particularly, using hydroxyapatite, machinability can be further improved by optimizing the crystallite size of hydroxyapatite. In this case, the mechanical properties and machinability of the sintered compacts can be further improved.

The results of our experiment to obtain the above findings will be now described.

A reduced iron powder (KIP®255A, produced by Kawasaki Steel Corporation as an iron-based powder, a mixture of a water-atomized copper powder containing about 75% of particles of 45 μm or less and a graphite powder having an average particle diameter of 5 μm used as an alloy powder, zinc stearate as a lubricant, and a hydroxyapatite ($Ca_{10}(PO_4)_6(OH)_2$ powder, average particle diameter 14 μm) having a crystallite size of each of about 190, 220, 450, 610, 690 and 880 Å as a machinability improving powder were put in a blender and then uniformly mixed therein to obtain an iron-based mixed powder. The amounts of the water-atomized copper powder, the graphite powder and the machinability improving powder were 1.5% by mass, 0.7% by mass and 0.05 to 1.3% by mass, respectively, based on the total amount of the iron-based powder, the alloy powder and the machinability improving powder. The amount of the lubricant mixed was 0.75 part by weight based on the total amount of 100 parts by weight of the iron-based powder, the alloy powder and the machinability improving powder.

The reduced iron powder used included 0.002% by mass of C, 0.03% by mass of Si, 0.21% by mass of Mn, 0.012% by mass of P, 0.003% by mass of S, and 0.26% by mass of O (the balance composed of iron and other inevitable impurities).

The crystallite size of hydroxyapatite, i.e., the crystal grain size in the hydroxyapatite powder, was determined by half value breadth method by X-ray diffraction and calculating according to the following equation (1):

$$B=0.9\lambda/t\cos\theta \quad (1)$$

B: half value breadth method, λ: 1.5417, t: crystallite size

The conditions of X-ray diffraction measurement were as follows:

Apparatus: RU-300 (Manufactured by Rigaku Denki Corporation)

Scan Speed: 0.5°/min

Measurement peak (002) plane, Cu Kα/λ, 55 KV, 250 mA

Divergent slit: 1.0 deg

Scattering slit: 1.0 deg

Light receiving slit: 0.15 mm

Then, a die(mold) was filled with the thus-obtained iron-based mixed powder, and pressing was carried out so that the green density was 6.8 $Mg/m^3$ to form a radial crushing test specimen ring of outer diameter 35 mm×inner diameter 14 mm×height 10 mm, and a drilling test specimen of outer diameter 60 mm×height 10 mm. Then, these specimens were sintered at 1130° C. for 20 min. in a RX gas atmosphere by using a mesh belt furnace.

These sintered specimens were subjected to a radial crushing test according to JIS Z 2507 and a drilling test under the conditions of a revolution speed of 10000 rpm and a feed of 0.012 mm/rev to determine radial crushing strength and the machinability. The number of bores formed until a drill (made of high speed steel, 1.2 mmø) was chipped was used as an index of machinability. The results are shown in FIGS. 3 and 4.

Figure 3:
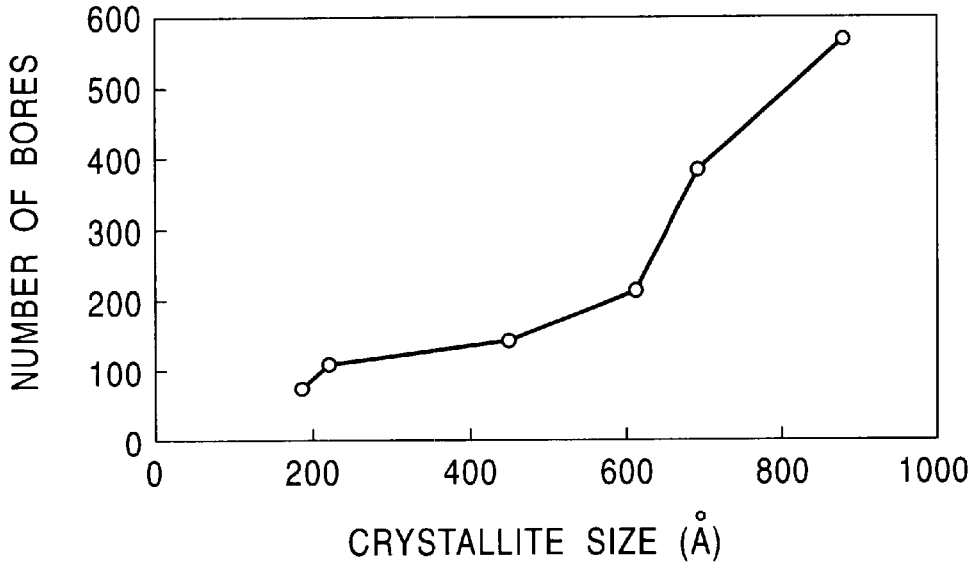
FIG. 3 is a graph showing the relationship between the number of bores and the crystallite size of hydroxyapatite in a drilling test.
Figure 4:
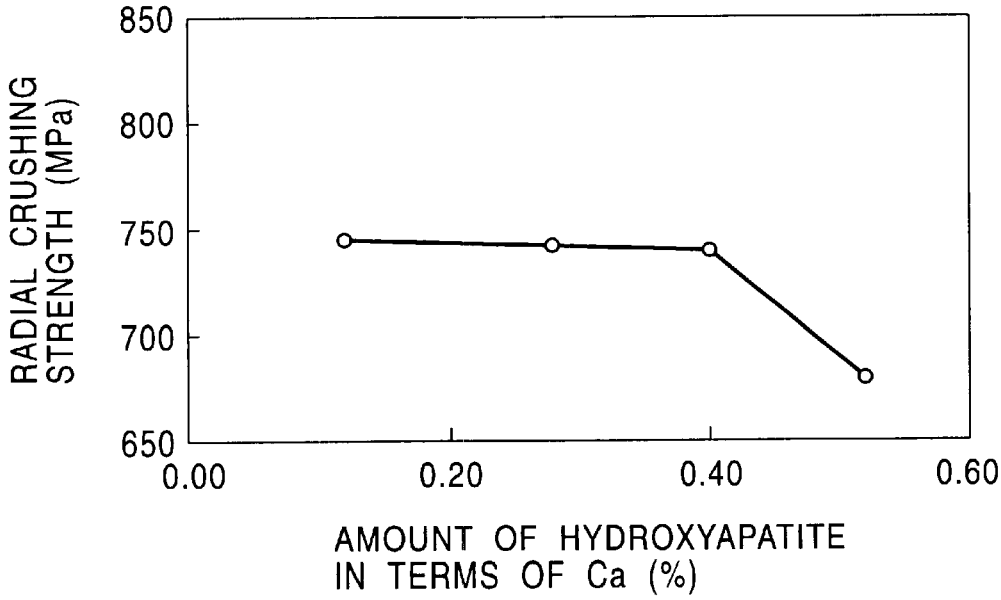
FIG. 4 is a graph showing the relationship between radial crushing strength and the content of hydroxyapatite in a radial crushing test.

FIG. 3 indicates that the number of bores increases as the crystallite size of hydroxyapatite increases. Particularly, with a crystallite size of 200 Å or more, a good value is obtained, and with a crystallite size of 600 Å or more, a significantly excellent value is obtained. FIG. 4 indicates that radial crushing strength decreases when the amount of hydroxyapatite mixed exceeds 1.0%. It is thus found that when the content of hydroxyapatite in the iron-based mixed powder is in the range of 0.05 to 1.0% by mass, both excellent machinability and high radical crushing strength can be obtained.

We further studied the appropriate amount of calcium phosphate compound added, or the appropriate amount of calcium fluoride additionally added, as described below. As a result, it was found that to add appropriate amounts of these chemical species, the total amount of Ca added may be controlled. Namely, the appropriate amount of tricalcium phosphate or hydroxyapatite singly added for improving machinability without deteriorating the mechanical properties of the sintered compact is in the range of about 0.05 to about 1.0% by mass based on the amount of the iron-based mixed powder. The amount can be generalized to about 0.02 to about 0.39% by mass in terms of Ca.

Since the effect of improving machinability without deteriorating the mechanical properties of the sintered compact cannot be sufficiently obtained by Ca-containing materials other than calcium phosphate compounds, Ca only itself does not have the effect, but Ca is possibly suitable as an index for the added amount because the ratio of Ca of the elements, which form the compounds, is relatively stable.

According to our research, the effect can be expected from not only calcium phosphate compounds, but also other phosphate compounds of alkali earth metals. However, the calcium phosphate compounds are preferred from the viewpoint of the effect on improving machinability and easiness for handling.

The reasons for the limitation and preferred range in the first embodiment of the invention will now be described.

The iron-based mixed powder for powder metallurgy of the first embodiment of the invention comprises the iron-based powder, the alloy powder, the machinability improving powder, and the lubricant, each of which can be a mixture of plural kinds of materials. When the alloy powder and/or the machinability improving powder is fixed to the surfaces of some or all of the ironbased powder, a binder is further mixed.

The machinability improving powder is a powder of (or containing) an alkali earth metal phosphate compound which can be a mixture of compounds. As the alkali earth metal phosphate compound, calcium phosphate compound, especially hydroxyapatite is preferred.

The iron-based mixed powder of the invention is characterized by using the alkali earth metal phosphate compound, particularly calcium phosphate compound, as the machinability improving powder. By using calcium phosphate compound machinability can be significantly improved without deterioration in the mechanical properties. Needless to say, the calcium phosphate compound can be mixture of plural kinds of phosphate compound.

Furthermore, the machinability improving powder is preferably a powder of (or containing) hydroxyapatite ($Ca_{10}(PO_4)_6(OH)_2$) having a crystallite size of over about 200 Å, preferably over about 600 Å. By using hydroxyapatite having a controlled crystallite size, machinability can be significantly improved without deterioration in the mechanical properties.

Although calcium phosphate compounds include tricalcium phosphate ($Ca_3(PO_4)_2$), calcium monohydrogen phosphate ($CaHPO_4$ or $CaHPO_4 \cdot 2H_2O$), and calcium dihydrogen phosphate ($Ca(H_2PO_4)_2$ or $Ca(H_2PO_4)_2$—$2H_2O$), other than hydroxyapatite, any one of these compounds can be preferably used in the invention. Particularly, tricalcium phosphate and calcium monohydrogen phosphate are preferred besides hydroxyapatite. In a combination of hydroxyapatite with other calcium phosphate, the same effect as or higher effect than use of hydroxyapatite alone can be obtained.

In these compounds, hydroxyapatite or tricalcium phosphate is most preferred for obtaining the effect of improving machinability.

The content of calcium phosphate compound in the iron-based mixed powder is preferably about 0.02 to about 0.39% by mass in terms of Ca based on the total amount of the iron-based powder, the alloy powder and the machinability improving powder. This content approximately corresponds to about 0.05 to about 1.0% by mass of tricalcium phosphate or hydroxyapatite.

The content (total) of calcium phosphate compound is preferably about 0.02% by mass or more in terms of Ca to significantly improve machinability. On the other hand, to maintain mechanical properties such as compressibility, crushing strength, etc., and suppress an increase in the rate of dimensional change of the sintered compact, the content is preferably about 0.39% by mass or less in terms of Ca. Therefore, the total content of calcium phosphate and/or hydroxyapatite in the iron-based mixed powder is preferably about 0.02 to about 0.39% by mass in terms of Ca.

The content is more preferably in the range of about 0.05 to about 0.6% by mass when using tricalcium phosphate ($Ca_3(PO_4)_2$) or hydroxyapatite alone. In this range, the dimensional change of the sintered compact is further decreased to cause no problem of parts' accuracy.

To further stably obtain the effect, the content is preferably in the range of about 0.2 to about 0.5% by mass corresponding to about 0.08 to about 0.20% by mass in terms of Ca.

The amount of the alkali earth metal added is about 0.02 to about 0.4% by mass based on the total amount of the iron-based powder, the alloy power, and the machinability improving powder when using a phosphate compound of an alkali earth metal other than calcium.

The machinability improving powder preferably has an average particle diameter of about 50 $\mu$m or less. Namely, coarse particles cause falling or chipping of the sintered compact to increase the rate of appearance defects and, thus, the average particle diameter is preferably decreased. However, in consideration of economy, the average particle diameter is appropriately about 50 $\mu$m or less. From the viewpoint of homogeneity in mixing, the machinability improving powder more preferably has an average particle diameter of about 30 $\mu$m or less. For the same reason, the maximum particle diameter of the machinability improving powder is about 200 $\mu$m or less, preferably about 45 $\mu$m or less.

In the invention, the particle diameter is measured by a micro track method (using a laser diffraction method).

Besides the alkali earth metal phosphate compound, the machinability improving powder may further contain an alkali earth metal fluoride which also can be a mixture of plural kinds of alkali earth metal fluoride. By using an alkali earth metal fluoride in combination with the alkali earth metal phosphate compound, machinability is improved, as compared with the use of calcium fluoride alone. Also, by mixing the alkali earth metal fluoride, improvement in the balance of overall machinability obtained in consideration of various processing forms can be expected, as compared with use of the alkali earth metal phosphate compound alone.

Particularly, calcium fluoride $CaF_2$ may be mixed with calcium phosphate compound. Namely, it is preferable to use the machinability improving powder containing calcium phosphate compound, and calcium fluoride, or composed of calcium phosphate compound.

In this case, the content of the machinability improving powder, i.e., the total content of calcium phosphate compound and calcium fluoride, is preferably in an the range of about 0.02 to about 0.39% by mass in terms of Ca based on the total amount of the iron-based powder, the powder for an alloy and the machinability improving powder. The content of calcium fluoride is preferably in the range of about 0.05 to about 0.15% by mass in terms of Ca based on the total amount of the iron-based powder, the alloy powder and the machinability improving powder.

The content ratio of calcium fluoride to calcium phosphate compound, FC value=(content of calcium fluoride)/(content of calcium phosphate compound), is preferably about 0.8 or more when using calcium fluoride in combination with calcium phosphate compound as the machinability improving powder. As a result, wear of the machine tool used can be significantly decreased to significantly improve machinability without deteriorating the mechanical properties of the sintered compact.

In evaluating the amount of flank wearing, to significantly improve machinability of the machine tool, the content (total) of calcium fluoride, calcium phosphate compound is preferably about 0.05% by mass or more in terms of Ca based on the total amount of the iron-based powder, the alloy powder, and the machinability improving powder. As calcium phosphate compound, tricalcium phosphate is more preferable besides hydroxyapatite.

The machinability improving powder preferably has the content of the alkali earth metal of about 0.02 to about 0.4% by mass based on the total amount of the iron-based powder, the alloy powder and the machinability improving powder when using the phosphate compound of the alkali earth metal other than calcium and/or the fluoride of the alkali earth metal other than calcium.

Although the additives added to the machinability improving powder are not limited, the machinability improving powder preferably contains substantially no S from the viewpoint of prevention of contamination of the sintering furnace. In some cases, it is preferred to avoid addition of additives having the defects described above in "Description of the related art", other than S-containing compounds. Therefore, as the machinability improving powder, the above-described compounds without additives are preferably used.

As the powder for an alloy ("alloy(ing) powder") contained in the iron-based mixed powder, a powder is selected from graphite powder, copper powder, nickel powder, and the like according the properties required for desired products, and contained in the iron-based mixed powder.

In the invention, as the iron-based powder, any one of pure iron powders such as atomized iron powder, reduced powder, and the like, steel powder (pre-alloyed steel powder) in which alloy elements such as Ni, Mo, Cr, V, Co, Mn, Cu and the like are previously alloyed, and steel powder (partially alloyed steel powder) in which these alloy elements are partially alloyed can be preferably used. Of course, these powders may be used in a mixture.

As the iron-based powder of the invention, the pure iron powder preferably comprises a composition in which the components are controlled to about 0.1% by mass or less of C, about 0.5% by mass or less of Si, about 0.5% by mass or less of Mn, about 0.040% by mass or less of P, about 0.05% by mass or less of S, and about 0.5% by mass or less of O, and the balance is composed of iron and inevitable impurities. The alloyed steel powder such as the pre-alloyed steel powder or partially alloyed steel powder preferably further contains at least one of about 1% by mass or less of Mn, about 7% by mass or less of Ni, about 5% by mass or less of Cu, about 7% by mass or less of Mo, about 5% by mass or less of Cr, about 0.5% by mass or less of V, and about 8% by mass or less of Co. The amount of the alloy contained is preferably about about 0.1% by mass or more, but the Mn content is preferably more than an ordinary value of about 0.5%. Of course, each of the alloy components may be added in the form of a powder for an alloy during mixing.

As the lubricant contained in the iron-based mixed powder, a metal soap such as zinc stearate, lithium stearate, or the like, or wax is preferably used.

The amount of the lubricant mixed is preferably about 0.2 to about 1.5 parts by weight based on the total amount of 100 parts by weight of the iron-based powder, the alloy powder and the machinability improving powder. Namely, to suppress friction with a die (mold) during pressing and the force to discharge the green compact from the die(mold), and secure the lifetime of the die and mold, the amount of the lubricant mixed is preferably about 0.2 part by weight or more. In addition, to maintain the green compact and the sintered compact at a high density, the amount of the lubricant mixed is preferably about 1.5 parts by weight or less.

The iron-based mixed powder of the invention can be obtained by adding the powder for an alloy, the machinability improving powder and the lubricant to the iron-based powder, and mixing the resultant mixture at one time or in at least two stages by a method using a generally known blender such as a V blender, a double cone blender, or the like.

Alternatively, the iron-based mixed powder may be subjected to segregation-free treatment comprising fixing the powder for an alloy and/or the machinability improving powder to the surfaces of the iron-based powder with a binder. The thus-obtained iron-based mixed powder has less segregation and excellent fluidity.

As the segregation-free treatment, for example, Japanese Patent No. 3004800 discloses a preferred method in which an iron-based powder, an alloy powder and a machinability improving powder are mixed together with a specified organic compound (at it least one compound) having the function as a binder, and then the resultant mixture is heated to a temperature 10° C. higher than the melting point of at least an organic compound of the specified organic compounds, which has the lowest melting point or, higher, to melt at least one of the organic compounds, and solidified by cooling to fix the powder for an alloy and/or the machinability improving powder to the surfaces of the iron-based powder. Examples of the specified organic compounds include but are not limited to higher fatty acids, higher fatty acid amides, and wax. Examples of higher fatty acids or higher fatty acid amides include but are not limited to stearic acid, oleamide, stearamide, ethylenebis(stearamide), a melted mixture of stearamide and ethylenebis(stearamide), and the like.

A second embodiment of the invention will be described below.

An iron-based mixed powder for powder metallurgy of the invention comprises a mixture of an iron-based powder, an alloy powder containing a graphite powder, a machinability improving powder, a binder and a lubricant.

In the invention, as the iron-based powder, any one of pure iron powders such as an atomized iron powder, a reduced powder and the like, a steel powder (pre-alloyed steel powder) in which alloy elements are previously alloyed, and a steel powder (partially alloyed steel powder) in which alloy elements are partially alloyed can be preferably used. Of course, these powders may be used in a mixture. The preferred composition of the iron-based powder is the same as the first embodiment.

As the alloy powder contained in the iron-based mixed powder, the graphite powder is necessary, and any one or more can be selected from the same metal powders alloyed metal powders as the first embodiment, such as a copper powder and the like, according to desired product properties. The content of the powder for an alloy is preferably in the range of about 0.5 to about 7% by mass based on the total amount of the iron-based powder, the alloy powder and the machinability improving powder.

The content of the machinability improving powder contained in the iron-based mixed powder is preferably about 0.1 to about 0.7% by mass based on the total amount of the iron-based powder, the alloy powder and the machinability improving powder. The content of the machinability improving powder is preferably about 0.1% by mass or more to improve the machinability improving effect. On the other hand, the content of the machinability improving powder is preferably about 0.7% by mass or less to improve compressibility of the iron-based mixed powder. The machinability improving effect tends to be saturated if the content of the machinability improving powder exceeds about 0.7% by mass.

In the second embodiment, the machinability improving powder contains an alkali earth metal fluoride powder, and preferably is composed of an alkali earth metal fluoride powder. The alkali earth metal fluoride powder preferably comprises at least one selected from calcium fluoride ($CaF_2$), magnesium fluoride ($MgF_2$), strontium fluoride ($SrF_2$), and barium fluoride ($BaF_2$). Particularly, from the viewpoint of improvement in machinability, calcium fluoride ($CaF_2$) is preferred.

In the second embodiment, the machinability improving powder, together with the graphite powder as the alloy powder, is fixed to the surfaces of the iron-based powder. The alkali earth metal fluoride powder as the machinability improving powder preferably has an average particle diameter of about 45 $\mu$m or less, more preferably about 25 $\mu$m or less. The average particle diameter is measured by using a laser diffraction method.

The machinability improving powder and the graphite powder are more preferably fixed to the concave portion of the iron powder, as described below.

Although additives other than alkali earth metal fluoride, which are added to the machinability improving powder, are not limited, the machinability improving powder preferably contains substantially no S from the viewpoint of prevention of contamination of the sintering furnace. With respect to additives other than S-containing compounds, it is preferred to avoid additives having the defects described above in "Description of the related art". Therefore, the machinability improving powder preferably substantially comprises only the alkali earth metal fluoride as a component. In use of other additives, generally, the other additives need not be fixed to the surfaces of the iron-based powder.

In the second embodiment of the invention, the iron-based powder contains the binder to fix the graphite powder and the machinability improving powder to the surfaces of the iron-based powder. The content of the binder in the iron-based mixed powder is preferably about 0.1 to about 1.0 part by weight based on the total amount of 100 parts by weight of the iron-based powder, the powder for an alloy and the machinability improving powder. Namely, to obtain a sufficient bonding effect, the content of the binder is preferably about 0.1 part by weight or more. On the other hand, to secure fluidity of the iron-based mixed powder, particularly, the property of discharge from a hopper (ease of discharge), the content of the binder is preferably about 1.0 part by weight or less.

As the binder, at least one is preferably selected from stearic acid, oleamide, a melted mixture of stearamide and ethylenebis(stearamide), and ethylenebis(stearamide). Alternatively, a heat melt of at least one of oleic acid, spindle oil and turbine oil, and zinc stearate may be used.

The iron-based mixed powder of the second embodiment preferably contains a free lubricant in a free state. The "free lubricant" represents the lubricant present in a free state in the iron-based mixed powder without being fixed to the iron-based powder, the alloy powder and/or the machinability improving powder. By using the free lubricant, the lubricant is easily softened or melted by frictional heat in pressing in a die or/and cavity to decrease the force to eject the green compact.

In the second embodiment of the invention, the amount of the lubricant (particularly, the free lubricant in the second embodiment) is preferably about 0.1 to about 0.5 part by weight based on the total amount of 100 parts by weight of the iron-based powder, the alloy powder and the machinability improving powder. The amount of the lubricant mixed is preferably about 0.1 part by weight or more to secure fluidity of the iron-based mixed powder. On the other hand, the amount of the lubricant mixed is preferably about 0.5 part by weight or less to prevent to lower the density of the green compact and the sintered compact. Improvement in fluidity is saturated when the amount of the lubricant mixed exceeds about 0.5 part by weight.

In the second embodiment, as the lubricant, it is preferred to use at least one selected from thermoplastic resin powders, zinc stearate, and lithium stearate. As the lubricant, it is also preferred to use a combination of A; at least one selected from thermoplastic resin powders, zinc stearate, and lithium stearate, and B; at least one selected from stearic acid, oleamide, stearamide, a melted mixture of stearamide and ethylnebis (stearamide), ethylnebis (stearamide), polyethylene having a molecular weight of about 10000 or less, and a melted mixture of ethylenebis(stearamide) and polyethylene having a molecular weight of about 10000 or less.

The thermoplastic resin powder preferably comprises a polymer of at least one monomer selected from acrylic acid esters, methacrylic acid esters, and aromatic vinyl compounds in an amount of about 50% by weight of the total amount of the thermoplastic resin powder, and has a primary particle diameter of about 0.03 to about 5 $\mu$m, an agglomerated average particle diameter of about 5 to about 50 $\mu$m and an average molecular weight of about 30,000 to about 5,000,000 measured by a solution specific viscosity method.

Figure 5:
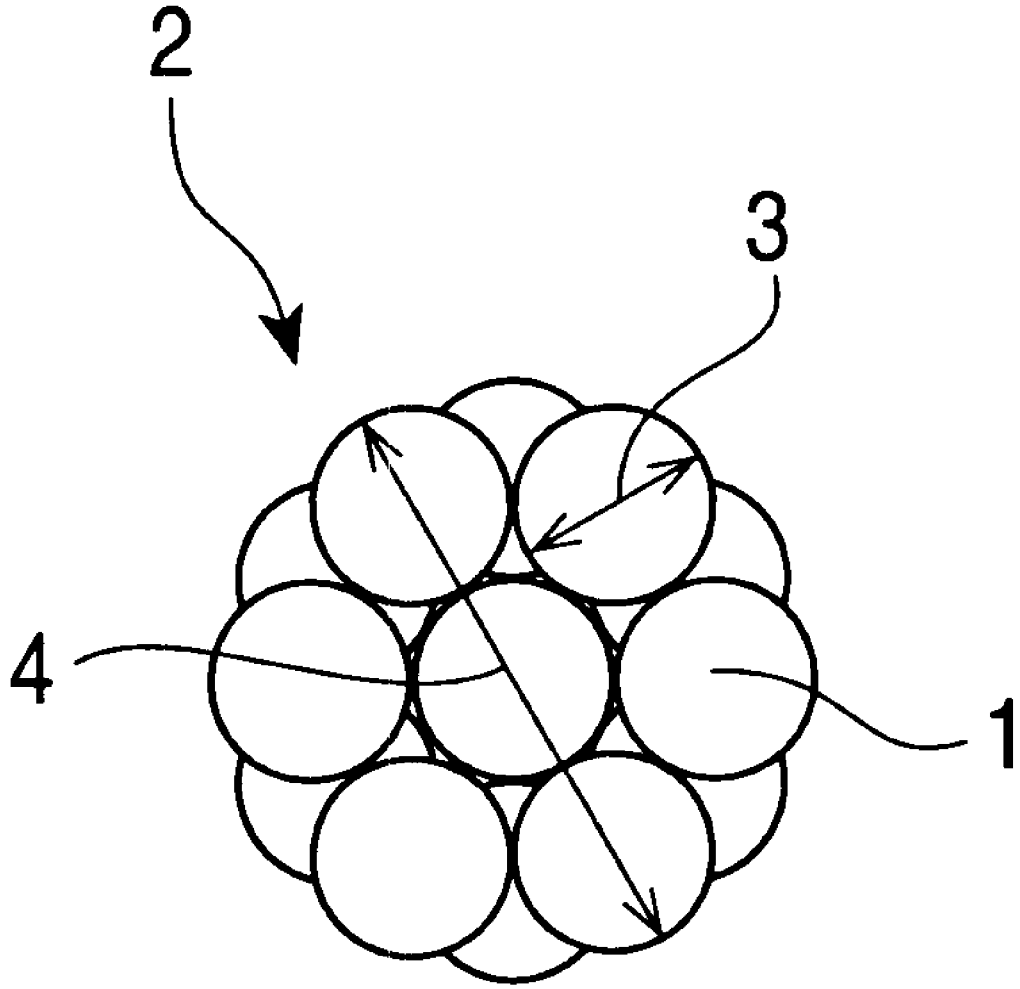
FIG. 5 is a drawing illustrating the definitions of primary average particle diameter and agglomerated average particle diameter.

In the second embodiment, as shown in FIG. 5, the "primary average particle diameter" represents the average value of particle diameters 3 of particles (primary particles 1) of the thermoplastic resin powder. The "agglomerated average particle diameter" represents the average of particle diameters 4 of agglomerated particles 2 formed by agglomeration of the primary particles 1. The primary average particle diameter is determined by averaging (arithmetic mean) the measured diameters of about 50 primary particles which form the agglomerated particles in a photograph obtained by observation on a scanning electron microscope. Similarly, the agglomerated average particle diameter is determined by averaging the measured diameters of about 50 agglomerated particles in a photograph obtained by observation on a scanning electron microscope.

In the second embodiment of the invention, the average molecular weight is measured by the solution specific viscosity method. In the solution specific viscosity method, viscosity A of a solution at 35° C. obtained by dissolving 0.2 g of test resin in 50 ml of tetrahydrofuran is determined as a ratio A/B (specific viscosity) to viscosity B of the solvent (tetrahydrofuran) at the same temperature, and the average molecular weight of the sample resin is determined from the relation between specific viscosity and average molecular weight, which is previously determined by using various reference polystyrenes having known average molecular weights.

The content of at least one monomer selected from acrylic acid esters, methacrylic acid esters, aromatic vinyl compounds is preferably about 50% by weight or more of the total amount of the thermoplastic resin powder to sufficiently obtain the effect of improving fluidity of the iron-based mixed powder. As the monomer, acrylic acid esters, methacrylic acid esters, and aromatic vinyl compounds may be used singly or in a combination of at least two monomers.

Examples of acrylic acid esters include methyl acrylate, ethyl acrylate, n-propyl acrylate, isopropyl acrylate, n-butyl actylate, isobutyl acrylate, sec-butyl acrylate, t-butyl acrylate, n-hexyl acrylate, cyclohexyl acrylate, 2-ethylhexyl acrylate, n-octyl acrylate, and the like.

Examples of methacrylic acid esters include methyl methacrylate, ethyl methacrylate, n-propyl methacrylate, isopropyl methacrylate, n-btuyl methacrylate, isobutyl methacrylate, n-hexyl methacrylate, cyclohexyl methacrylate, 2-ethylhexyl methacrylate, n-octyl methacrylate, and the like. Of these monomers, methyl methacrylate is particularly preferably used.

Examples of aromatic vinyl compounds include styrene, α-methylstyrene, divinylbenzene; monomers such as vinyltoluene, isobutylstyrene, and the like, in which benzene nuclei of monomers of styrene, α-methylstyrene or divinylbenzene are substituted by a methα-methylstyrene yl group, an ethyl group, a propyl group, a butyl group, or the like.

Alternatively, another copolymerizable monomer may be added to at least one monomer selected from the acrylic acid esters, the methacrylic acid esters, and the aromatic vinyl compounds in an amount of about O to about 45% by mass based on the total amount of the monomers to form a thermoplastic resin used as the free lubricant.

Examples of other monomers copolymerizable with the three types of monomers include unsaturated carboxylic acids such as acrylic acid, methacrylic acid, 2-ethylacrylic acid, crotonic acid, cinnamic acid, and the like; unsaturated dicarboxylic acids such as maleic acid, itaconic acid, fumaric acid, citraconic acid, chloromaleic acid, and the like, and anhydrides thereof; unsaturated dicarboxylic acid monoesters such as monomethyl maleate, monobutyl maleate, monomethyl fumarate, monoethyl fumarate, monomethyl itaconate, monoethyl itaconate, monobutyl itaconate, and the like, and derivatives thereof; glycidyl methacrylate, glycidyl acrylate, glycidyl-p-vinyl benzoate, methylglycidyl itaconate, ethylglycidyl maleate, glycidyl vinyl phosphonate, and glycidyl ethers; epoxyide olefins such as butadiene monoxide, vinylcyclohexene monoxide, 5,6-epoxyhexene, 2-methyl-5,6-epoxyhexene, and the like; vinyl cyanides such as acrylonitrile, methacrylonitrile, and the like; vinyl esters such as vinyl acetate, vinyl propionate, vinyl myristate, vinyl oleate, vinyl benzoate, and the like; conjugated diene compounds such as butadiene, isoprene, 1,3-pentadiene, cyclopentadiene, and the like; disconjugate diene compounds such as 1,4-hexadiene, dicyclopentadiene, ethylidene norbornene, and the like.

Alternatively, a crosslinking monomer having at least two double bonds having substantially same reactivity may be added as the copolymerizable monomer in an amount of about 0.1 to about 2% by mass based on the total mount of the monomers. Examples of the crosslinking monomer include ethylene glycol diacrylate, ethylene glycol dimethacrylate,. butylene glycol diacrylate, butylene glycol dimethacrylate, trimethylol propane diacrylate, trimethylol propane dimethacrylate, trimethylol propane triacrylate, trimethylol propane trimethacrylate, hexanediol diacrylate, hexanediol dimethacrylate, oligoxy ethylene diacrylate, oligoxyethylene dimethacrylate, aromatic divinyl monomers such as divinylbenzene and the like, triallyl trimellitate, triallyl isocyanurate, and the like.

The thermoplastic resin powder preferably has a primary average particle diameter of about 0.03 to about 5.0 μm. The primary average particle diameter is preferably about 0.03 μm or more to produce the iron-based mixed powder at a reasonable production cost. On the other hand, the primary average particle diameter is preferably about 5.0 μm or less to maintain the green compact at a good density (referred to simply as "compressibility" hereinafter). The primary average particle diameter is more preferably about 0.05 to about 3.0 μm.

The agglomerated average particle diameter of the thermoplastic resin powder is preferably in the range of about 5 to about 50 μm. The agglomerated average particle diameter is preferably about 5 μm or more to maintain fluidity of the iron-based mixed powder and the property of discharge from the hopper in a good condition. On the other hand, the agglomerated average particle diameter is preferably about 50 μm or less to maintain the sintered compact at good tensile strength. The agglomerated average particle diameter is more preferably about 10 to about 40 μm.

A mixture of at least two thermoplastic resin powders having different primary average particle diameters can be used as the thermoplastic resin powder. In this case, the mixing ratio is preferably controlled so that the primary average particle diameter of the thermoplastic resin powder mixture is about 0.03 to about 5.0 μm.

Also, the average molecular weight of the thermoplastic resin powder, which is measured by the solution specific viscosity method, is preferably in the range of about 30,000 to about 5,000,000. The average molecular weight is about 30,000 or more to produce the iron-based mixed powder at reasonable production cost. On the other hand, the average molecular weight is about 5,000,000 or less to maintain the fluidity of the iron-based mixed powder and the property of discharge from the hopper in a good condition.

Although the method of producing the thermoplastic resin powder is not limited, any one of methods conventionally used for producing fine resin powders such as polymethyl methacrylate and the like is preferably used. Of these methods, a polymerization method capable of obtaining spherical particles without producing ultrafine particles, for example, such as a fine suspension polymerization method, an emulsion polymerization method, a seeding emulsion polymerization method, or the like, is particularly preferred.

In the iron-based mixed powder of the invention, the graphite powder as the alloy powder and the machinability improving powder is adhered to the surfaces (particularly, the concave portion on the surfaces) of the iron-based powder. The machinability is improved by increasing the degrees of adhesion of the graphite powder and the machinability improving powder. In the invention, the degree of adhesion of each of the graphite powder and the machinability improving powder (the alkali earth metal flourid) is preferably about 60% or more. The degree of adhesion of the graphite powder is defined by the following equation (1):

Degree of adhesion of graphite powder=(C content of powders having particle sizes of 200 mesh or more and 100 mesh or less)/(C content of the whole iron-based mixed powder) (1)

The degree of adhesion of the machinability improving powder is defined by the following equation (2):

Degree of adhesion of machinability improving powder=(F content of powders having particle sizes of 200 mesh or more and 100 mesh or less)/(F content of the whole iron-based mixed powder) (2)

The preferred method of producing the iron-based mixed powder of the invention will be described below.

First, the alloy powder containing the graphite powder, the machinability improving powder containing the alkali earth metal fluoride at the above-described content, and the binder are added to the iron-based powder to form a mixture.

Then, when using of one binder, the resultant mixture is heated to a temperature of about 10 to about 100° C. higher than the melting point of the binder, while, when using at least two binders, the mixture is heated to a temperature of about lowest melting point+10° C. to the highest melting point, under mixing (primary mixing). In this step, at least one binder is melted, and the heating temperatures are preferably limited to the above values or less to prevent deterioration of the function of the binders due to thermal decomposition.

After at least one binder is melted and mixed, the primary mixture is cooled to strongly fix the graphite power and the machinability improving powder composed of the alkali earth metal fluoride to the surfaces (particularly, the concave portion on the surfaces) of the iron-based powder.

Then, the lubricant is added to the primary mixture, and mixed at a temperature of less than the lowest melting point of the lubricant, preferably at room temperature (secondary mixing). In this step, the type and amount of the lubricant used are preferably selected from the above described types and amounts. The mixing method may be a generally known mixing method, and need not be limited.

The iron-based mixed powder of the invention may be produced by the following steps (1) to (4):

(1) The powder for an alloy and the machinability improving powder are added to the iron-based powder, and the liquid binder is sprayed onto the resultant mixture, followed by mixing. As the liquid binder, at least one of oleic acid, spindle oil, and turbine oil is preferably used.

(2) Furthermore, zinc stearate is added to the mixture and mixed to form a primary mixture. With respect to the amount of zinc stearate added, the total amount of zinc stearate and at least one of oleic acid, spindle oil, and turbine oil is preferably about 0.1 to about 1.0 part by weight of the total amount of 100 parts by weight of the iron-based powder, the alloy powder and the machinability improving powder.

(3) The primary mixture is secondarily mixed while being heated to about 110 to about 150° C. In this heating, at least a heat melt of zinc stearate and at least one of oleic acid, spindle oil, and turbine oil is produced. When the heating temperature of secondary mixing is less than about 110° C., the graphite powder and the machinability improving powder are less fixed to the iron-based powder to deteriorate machinability in some cases. On the other hand, with a heating temperature of over about 150° C., the iron-based powder is possibly oxidized to cause the probability that the iron powder is hardened by oxidation to deteriorate compressibility.

Then, the secondary mixed powder is cooled to strongly fix the graphite power and the machinability improving powder composed of the alkali earth metal fluoride to the surfaces (particularly, the concave portion on the surfaces) of the iron-based powder.

(4) Then, the lubricant is further added to the secondary mixed powder in which the graphite powders and the machinability improving powder containing (or composed) of the alkali earth metal fluoride are fixed to the surfaces of the iron-based powder, followed by tertiary mixing to form the iron-based mixed powder. The temperature of tertiary mixing is preferably less than the lowest melting point of the lubricants added, and preferably room temperature. The amount of the lubricant added is preferably about 0.1 to about 0.5 part by weight based on the total amount of 100 parts by weight of the iron-based powder, the alloy powder and the machinability improving powder. The lubricant added in tertiary mixing becomes a free lubricant which is present in a free state in the mixed powder without being bonded to the iron-based powder, etc.

The type of the lubricant added in tertiary mixing may be the same as the above-described free lubricant without any problem.

The method of producing the iron-based mixed powder of the second embodiment of the invention is preferably one of the above-described two production methods. For example, another method may be used in which the binder dissolved or dispersed in an organic solvent is mixed with the iron-based powder, the alloy powder and the machinability improving powder, the organic solvent is evaporated to fix the alloy powder and the machinability improving powder to the surfaces of the iron-based powder, and then the lubricant is added and mixed. However, this method has some effect, but is less effective in improving machinability than the above two methods.

As a result of research on the difference between these production methods, we concluded that the difference is likely due to the difference in the state in which the graphite powder and the machinability improving powder are adhered to the surfaces of the iron-based powder. Namely, the iron-based powder is seldom uniformly spherical, but has some irregularity. The method of dissolving the binder in the organic solvent and evaporating the organic solvent increases the adhesive force of the binder to the entire surfaces (regardless of the shape of irregularity such as bump or concave) of the iron-based powder in evaporation of the organic solvent, thereby fixing the graphite powder and the machinability improving powder to all irregularities of the surfaces of the iron-based powder. Therefore, the graphite powder and the machinability improving powder are less fixed to each other to fail to exhibit the maximum machinability improving effect.

On the other hand, in the above two methods in which the binder (at least a part) is melted, the melted binder is easily locally present in concave portion of the surfaces of the iron-based powder to significantly increase adhesive force at the concave portion, thereby fixing most of the powders (graphite powder and the machinability improving powder) to the concave portion on the surface of the iron-based powder. The phenomenon was confirmed by SEM observation. Therefore, the graphite powder and the machinability improving powder are often fixed to each other, thereby possibly significantly increase the machinability improving effect.

Therefore, in the second embodiment, the graphite powder and the machinability improving powder are preferably fixed to the concave portion on the surface of the iron-based powder. As the means for fixing the graphite powder and the machinability improving powder to the iron-based powder, a method of mainly fixing to the concave portion of the iron-based powder is preferred.

Any one of production processes for general powder metallurgy can be applied to the iron-based mixed powders of the first and second embodiments. The iron-based mixed powder may be sintered after pressing to form a sintered compact, and then processed by machining or the like to form a product. Alternatively, the iron-based mixed powder may be sintered after pressing, and then heat-treated by carburizing, bright hardening, induction hardening, or the like and following tempering if necessary to form a product.

The pressing condition for obtaining the sintered compact preferably includes a green density in the range of about 6.0 to about 7.3 $Mg/m^3$ after pressing. In subsequent sintering, the green compact is preferably heated at a temperature of about 1000 to about 1300° C. for about 5 to about 180 minutes.

The composition of the iron-based mixed powder used as a raw material of the sintered compact corresponds to the sum of the components of the iron-based powder, the alloy powder, the machinability improving powder and the lubricant.

On the other hand, the composition of the sintered compact can be said to be the following:

In sintering, the lubricant is substantially completely decomposed and volatilized by heating and, thus, the upper limit of the content of the components of the sintered compact except iron corresponds to the sum (referred to as the "raw material component" hereinafter) of the components of the iron-based powder, the alloy powder and the machinability improving powder. Although the alloy components are generally less affected by sintering, surface decarburization occurs in sintering in some cases. Therefore, in some cases, the C content of the sintered compact is lower than that of the raw material component. Also, in use of graphite, graphite reacts (mainly producing CO) with oxygen contained in the iron-based powder to cause deoxidization and decarburization. In this case, therefore, the O content of the sintered compact is a value obtained by subtracting the O content of the iron-based powder from that of the raw material component, and the C content is substantially equal to a value obtained by subtracting the C content (about ¾ of the O decrement by weight) corresponding to the O decrement.

The machinability improving powder (particularly, calcium phosphate compound, calcium fluoride, or the like) generally causes less chemical reaction in sintering. Therefore, the sintered compact of the invention preferably contains calcium phosphate compound, and the content of this material is preferably about 0.01 to about 0.39% by mass (in terms of Ca) based on the total amount of the sintered compact in consideration of some loss in weight by reaction.

When the content is converted to the amount of the main element, the Ca content of the sintered compact is about 0.02 to about 0.39% by mass based on the total of the sintered compact. Since the P content of the sintered compact is higher than the iron-based powder by about 001 to about 0.06% by mass, the maximum P content of the entire sintered compact is about 0.64% by mass. Therefore, the sintered compact of the invention is different from conventional sintered compacts in the Ca and P contents. Particularly, with the P content of over about 0.040% by mass (the allowable maximum value of industrial iron-based powders), the sintered compact of the invention can be clearly discriminated from conventional sintered compacts containing a Ca compound other than a phosphate system only by the components.

The requirements, the preferred conditions and production means of the first embodiment can be applied to the second embodiment in a range in which the idea of each of the embodiments is not impaired. Alternatively, the requirements, the preferred conditions and production means of the second embodiment can be applied to the first embodiment in a range in which the idea of each of the embodiments is not impaired.

EXAMPLES

Example 1

First Embodiment

A water-atomized iron powder (trade name: KIP®301 A produced by Kawasaki Steel Corporation) was used as an iron-based powder. 100 kg of the iron-based powder; a graphite powder (average particle diameter: 4 μm) or electrolytic copper powder (average particle diameter: 35 μm) used as alloy powder in the amount (% by mass) shown in Table 1 based on the total of the iron-based powder, the alloy powder and a machinability improving powder; at least one of various calcium phosphate compound powders, or a calcium fluoride powder (average particle diameters: 9 to 12 μm and 10 μm, respectively) used as the machinability improving powder (powder for improving machinability) in the mixing amount (% by mss) shown in Table 1; and zinc stearate (average particle diameter: 20 μm) or a wax as a lubricant in the amount (parts by weight) shown in Table 1 based on the total amount of 100 parts by weight of the iron-based powder, the alloy powder and the machinability improving powder were put in a V-blender, and uniformly mixed to form an iron-based mixed powder.

In some iron-based mixed powders, a mill scale reduced iron powder (trade name: KIP®255 M produced by Kawasaki Steel Corporation), a partially alloyed steel powder (4 mass % Ni-0.5 mass % Mo-1.5 mass % Cu-Fe) in which Ni, Mo and Cu were diffusively adhered to the surfaces of a water-atomized iron powder and a mixed powder of a water-atomized iron powder and a partially alloyed steel powder (2 mass % Ni-0.5 mass % Mo-1.5 mass % Cu-Fe) in which Ni, Mo and Cu were diffusively adhered to the surfaces of an iron powder was used as the iron-based powder. The iron-based mixed powders included an iron-based mixed powder containing no machinability improving powder, and an iron-based mixed powder containing MnS as the machinability improving powder.

A die(mold) was filled with each of the thus-formed iron-based mixed powders, and compression pressing was carried out at compacting pressure of 392 MPa to form ring-shaped specimen green compacts of outer diameter 35 mm×inner diameter 14 mm×height 10 mm for a radial crushing test and a test for measuring a rate of dimensional change in the outer diameter, a disk-shaped specimen green compact of outer diameter 60 mm×height 10 mm for a drilling test, and a rectangular green compact of 10×10×55 mm. The density of the rectangular green compact was measured by an Archimedes method. The Archimedes method is a method for measuring the density in which the green compact as a measurement object is immersed in water to measure the volume thereof.

The green compacts (specimen) were sintered at 1130° C. for 20 minutes in a RX gas atmosphere by using a mesh belt furnace to form sintered compacts.

Each of the sintered compacts (specimens) was subjected to the radial crushing test and the test for measuring a rate of dimensional change in the outer diameter, and the drilling test under conditions including a revolution speed of 10000 rpm and a feed of 0.012 mm/rev to determine radial crushing strength ($N/mm^2$), the rate of dimensional change in the outer diameter and the number of bores. The radial crushing strength ($N/mm^2$) was determined according to JIS Z 2507. The rate of dimensional change in the outer diameter was determined by measuring the outer diameter of the ring-shaped specimen based on the outer diameter of the die (mold) after sintering to determine the rate of change relative to the outer diameter of the die(mold)(={(average diameter of the ring-shaped specimen after sintering−outer diameter of the die(mold))/(outer diameter of the die(mold))}×100%). This rate of change was considered as the rate of dimensional change in the outer diameter. The of the bores formed until a drill (made of high-speed steel, 1.2 mmø) was chipped was used as index of the machinability.

The results are shown in Table 1.

TABLE 1-1

| Mixed powder No. | Iron-based powder Type* | Powder for alloy Type | Powder for alloy Content** % by mass | Powder for improving machinability Type | Powder for improving machinability Content** in terms of Ca % by mass | Lubricant Type | Lubricant Content*** parts by weight |
|---|---|---|---|---|---|---|---|
| 1-1 | a | Graphite powder | 0.70 | — | — | Zinc stearate | 0.75 |
| 1-2 | a | Graphite powder | 0.70 | Tricalcium phosphate | 0.13 | Zinc stearate | 0.75 |
| 1-3 | a | Graphite powder | 0.70 | Calcium monohydrogen phosphate ($CaHPO_4.2H_2O$) | 0.10 | Zinc stearate | 0.75 |
| 1-4 | a | Graphite powder | 0.70 | Tricalcium phosphate | 0.39 | Zinc stearate | 0.75 |
| 1-5 | a | Graphite powder | 0.70 | Tricalcium phosphate | 0.46 | Zinc stearate | 0.75 |
| 1-6 | b | Graphite powder Cu powder | 0.60 2.00 | Tricalcium phosphate | 0.09 | Zinc stearate | 0.75 |
| 1-7 | b | Graphite powder Cu powder | 0.60 2.00 | Tricalcium phosphate | 0.22 | Zinc stearate | 0.75 |
| 1-8 | b | Graphite powder Cu powder | 0.60 2.00 | Tricalcium phosphate | 0.35 | Zinc stearate | 0.75 |
| 1-9 | b | Graphite powder Cu powder | 0.60 2.00 | — | — | Zinc stearate | 0.75 |
| 1-10 | c | Graphite powder Cu powder | 0.8 1.0 | Tricalcium phosphate | 0.12 | Zinc stearate | 1.2 |
| 1-11 | c | Graphite powder Cu powder | 0.8 1.0 | — | — | Zinc stearate | 1.2 |
| 1-12 | c | Graphite powder Cu powder | 0.8 1.0 | MnS powder | 0.5**** | Zinc stearate | 1.2 |

| Mixed powder No | Green Compact Density $Mg/m^3$ | Properties of sintered compact: Radial crushing strength Mpa | Properties of sintered compact: Machinability Number of bores | Properties of sintered compact: Rate of dimensional change % | Appearance of sintered compact | Remarks |
|---|---|---|---|---|---|---|
| 1-1 | 6.75 | 430 | 8 | 0.15 | Good | Comparative Example |
| 1-2 | 6.74 | 425 | 390 | 0.14 | Good | Example of this invention |
| 1-3 | 6.74 | 400 | 605 | .015 | Good | Example of this invention |
| 1-4 | 6.69 | 380 | 720 | 0.11 | Good | Example of this invention |
| 1-5 | 6.60 | 260 | 780 | 0.09 | Good | Comparative Example |
| 1-6 | 6.81 | 810 | 120 | 0.340 | Good | Example of this invention |
| 1-7 | 6.78 | 805 | 195 | 0.345 | Good | Example of this invention |

TABLE 1-1-continued

| | | | | | | |
|---|---|---|---|---|---|---|
| 1-8 | 6.72 | 720 | 220 | 0.350 | Good | Example of this invention |
| 1-9 | 6.82 | 830 | 5 | 0.302 | Good | Comparative Example |
| 1-10 | 6.65 | 685 | 43 | 0.10 | Good | Example of this invention |
| 1-11 | 6.65 | 690 | 7 | 0.05 | Good | Comparative Example |
| 1-12 | 6.62 | 620 | 40 | 0.02 | Black stain | Comparative Example |

TABLE 1-2

| | | Powder for alloy | | Powder for improving machinability | | Lubricant | |
|---|---|---|---|---|---|---|---|
| Mixed powder No. | Iron-based powder Type* | Type | Content** % by mass | Type | Content** in terms of Ca % by mass | Type | Content*** parts by weight |
| 1-14 | d | Graphite powder | 0.5 | Tricalcium phosphate | 0.23 | Zinc stearate | 0.8 |
| 1-15 | c | Graphite powder | 0.8 | Tricalcium phosphate | 0.12 | Wax | 1.2 |
| 1-16 | c | Graphite powder | 0.8 | Hydroxyapatite | 0.16 | Zinc stearate | 1.2 |
| 1-17 | c | Graphite powder | 0.8 | Tricalcium phosphate<br>Calcium fluoride | 0.12<br>0.15 | Zinc stearate | 1.2 |
| 1-18 | c | Graphite powder | 0.8 | Hydroxyapatite<br>Calcium fluoride | 0.12<br>0.15 | Zinc stearate | 1.2 |
| 1-19 | c | Graphite powder | 0.8 | Hydroxyapatite<br>Calcium monohydrogen phosphate ($CaHPO_4.2H_2O$) | 0.12<br>0.12 | Zinc stearate | 1.2 |
| 1-20 | c | Graphite powder | 0.8 | Hydroxyapatite<br>Tricalcium phosphate<br>Calcium fluoride | 0.08<br>0.08<br>0.10 | Zinc stearate | 1.2 |
| 1-21 | a | Graphite powder<br>Cu powder | 0.6<br>2.0 | Calcium monohydrogen phosphate ($CaHPO_4.2H_2O$) | 0.06 | Zinc stearate | 0.75 |
| 1-22 | a | Graphite powder<br>Cu powder | 0.6<br>2.0 | Calcium dihydrogen phosphate ($Ca(HPO_4)_2.H_2O$) | 0.08 | Zinc stearate | 0.75 |
| 1-23 | c | Graphite powder | 0.8 | Calcium monohydrogen phosphate ($CaHPO_4$) | 0.08 | Zinc stearate | 1.2 |

| | | Properties of sintered compact | | | | |
|---|---|---|---|---|---|---|
| Mixed powder No | Green Compact Density $Mg/m^3$ | Radial crushing strength Mpa | Machinability Number of bores | Rate of dimensional change % | Appearance of sintered compact | Remarks |
| 1-14 | 6.90 | 1100 | 10 | 0.03 | Good | Example of this invention |
| 1-15 | 6.65 | 680 | 41 | 0.08 | Good | Example of this invention |
| 1-16 | 6.65 | 690 | 30 | 0.10 | Good | Example of this invention |
| 1-17 | 6.65 | 685 | 35 | 0.07 | Good | Example of this invention |
| 1-18 | 6.65 | 680 | 40 | 0.08 | Good | Example of this invention |
| 1-19 | 6.65 | 688 | 38 | 0.09 | Good | Example of this invention |

TABLE 1-2-continued

| | | | | | | |
|---|---|---|---|---|---|---|
| 1-20 | 6.64 | 680 | 42 | 0.11 | Good | Example of this invention |
| 1-21 | 6.75 | 425 | 680 | 0.15 | Good | Example of this invention |
| 1-22 | 6.74 | 415 | 705 | 0.13 | Good | Example of this invention |
| 1-23 | 6.64 | 685 | 30 | 0.06 | Good | Example of this invention |

TABLE 1-3

| | | Powder for alloy | | Powder for improving machinability | | | Lubricant | |
|---|---|---|---|---|---|---|---|---|
| Mixed powder No. | Iron-based powder Type* | Type | Content** % by mass | Type | Content** in terms of Ca % by mass | Type | Content*** parts by weight |
| 1-24 | a | Graphite powder<br>Cu powder | 0.6<br>2.0 | Calcium monohydrogen phosphate ($CaHPO_4$)<br>Tricalcium phosphate<br>Calcium dihydrogen phosphate ($Ca(HPO_4)_2$) | 0.02<br>0.03<br>0.02 | Zinc stearate | 0.75 |
| 1-25 | a | Graphite powder | 0.7 | Tricalcium phosphate | 0.22 | Zinc stearate | 0.75 |
| 1-26 | c | Graphite powder | 0.8 | Hydroxyapatite<br>Tricalcium phosphate | 0.12<br>0.12 | Zinc stearate | 1.2 |
| 1-27 | b | Graphite powder<br>Cu powder | 0.60<br>2.00 | Calcium fluoride | 0.03 | Zinc stearate | 0.75 |
| 1-28 | c | Graphite powder | 0.7 | Calcium fluoride | 0.03 | Zinc stearate | 1.2 |

| | | Properties of sintered compact | | | | |
|---|---|---|---|---|---|---|
| Mixed powder No | Green Compact Density $Mg/m^3$ | Radial crushing strength Mpa | Machinability Number of bores | Rate of dimensional change % | Appearance of sintered compact | Remarks |
| 1-24 | 6.75 | 420 | 520 | 0.12 | Good | Example of this invention |
| 1-25 | 6.73 | 400 | 605 | 0.15 | Good | Example of this invention |
| 1-26 | 6.65 | 688 | 38 | 0.09 | Good | Example of this invention |
| 1-27 | 6.72 | 825 | 15 | 0.311 | Good | Comparative Example |
| 1-28 | 6.62 | 680 | 7 | 0.05 | Good | Comparative Example |

*a: Water-atomized iron powder
b: Reduced iron powder
c: 70% water atomized iron powder + 30% partially alloyed steel powder (2Ni-0.5Mo-1.5Cu—Fe)
d: 100% partially alloyed steel powder (4Ni-0.5Mo-1.5Cu—Fe)
**Based on the total of (iron-based powder + powder for alloy + powder for improving machinability)
***Based on the total of 100 parts by weight of (iron-based powder + powder for alloy + powder for improving machinability)
****MnS powder content by % by mass Although each of the obtained properties depends upon the components of the iron-based mixed powders, in a comparison between similar component systems, the green compacts of the examples of this invention have relatively a high density, and the sintered compacts have high crushing strength and a low rate of dimensional change in the outer diameter. Also, in the examples of this invention, sintered compacts having a large number of bores and excellent machinability can be formed and, thus, the iron-based mixed powders of this invention have excellent properties as iron-based mixed powders for powder metallurgy.

On the other hand, in the comparative examples and conventional example out of the range of this invention, the green compacts have a low density, or the sintered compacts have low radial crushing strength, a high rate of dimensional change in the outer diameter, or low machinability. In the iron-based mixed powder (conventional example) containing a S-containing machinability improving powder, defects such as sooting were observed in the appearance of the sintered compact.

The composition of the water-atomized iron powder (symbol a in Table 1) was 0.001% C-0.01% Si-0.13% Mn-0.01% P-0.01% S-0.11% O, and the composition of the reduced iron powder (symbol b in Table 1) was 0.002% C-0.03% Si-0.20% Mn-0.01% P-0.03% S-0.26% 0. In both compositions, the balance was composed of iron and other inevitable impurities (particularly, about 0.05% of Cr) (% by mass). The partially alloyed steel powders respectively represented by symbols c and d in Table 1 were produced by using an atomized iron powder as a base, and contained the same main components as the iron powder a.

The composition of each of the resultant iron-based mixed powders substantially corresponded to the sum of the iron-based powder components and the components of the powder for an alloy, the alloy powder, the machinability improving powder and the lubricant shown in Table 1.

In the composition sintered compact containing each of the iron-based powders a, c, and d, the O and C contents were lower than those of the sum of the components of the iron-based iron powder, the powder for an alloy and the machinability improving powder by about 0.11% by mass and about 0.09% by mass, respectively. In the composition of the iron-based mixed powder containing the iron-based powder b, the O content and C content were lower those of the sum of the components by about 0.26% by mass and about 0.20% by mass, respectively.

Example 2

First Embodiment

A water-atomized iron powder (trade name: KIP®301 A produced by Kawasaki Steel Corporation) was used as the iron-based powder. A natural graphite powder (average particle diameter: 4 μm) or a mixture of a graphite powder and an electrolytic copper powder (average particle diameter: 35 μm) used as the powder for an alloy in the amount (% by mass) based on the total amount of the iron-based powder, the powder for an alloy and the machinability improving powder shown in Table 2; at least one of tricalcium phosphate powder (maximum particle diameter: 45 μm or less, average particle diameter: 20 μm), calcium monohydrogen phosphate $CaHPO_4.2H_2O$ (maximum particle diameter: 28 μm, average particle diameter: 14 μm), and calcium dihydrogen phosphate $Ca(HPO_4)_2.H_2O$ (maximum particle diameter: 31 μm, average particle diameter: 16 μm) used as the machinability improving powder in the mixing amount (% by mass) shown in Table 2;, and zinc stearate (melting point; 120° C.) used as the binder in an amount of 0.4 part by weight based on the total amount of 100 parts by weight of the iron-based powder, the powder for an alloy and the machinability improving powder were added to 100 Kg of the iron-based powder, followed by primary mixing.

Then, the resultant mixture was heated to 120° C. to melt the binder under mixing, and then cooled to fix the powder for an alloy and/or the machinability improving powder to the surfaces of the iron-based powder, to form an iron-based powder subjected to segregation-free treatment. Furthermore, zinc stearate (average particle diameter: 20 μm) as the lubricant was added in the amount (parts by weight) based on the total amount of 100 parts by weight of the iron-based powder, the powder for an alloy and the machinability improving powder shown in Table 2, and uniformly mixed to form an iron-based mixed powder.

Like in Example 1, a die(mold) was filled with each of the thus-formed iron-based mixed powders, and pressing was carried out at compacting pressure of 490 MPa to form ring-shaped specimen of green compacts with outer diameter 35 mm×inner diameter 14 mm×height 10 mm for a radial crushing test and a test for measuring a rate of dimensional change in the outer diameter, a disk-shaped specimen of green compact with outer diameter 60 mm×height 10 mm for a drilling test, and a rectangular green compact of 10×10×55 mm. The density of the rectangular green compact was measured by the Archimedes method.

The specimen of green compacts were sintered at 1120° C. for 15 minutes in a RX gas atmosphere by using the mesh belt furnace to form sintered compacts.

Each of the sintered compacts (specimens) was subjected to the radial crushing test, the test for measuring a rate of dimensional change in the outer diameter, and the drilling test by the same method as Example 1 to determine radial crushing strength ($N/mm^2$), the rate of dimensional change in the outer diameter and the machinability (the number of bores). The results are shown in Table 2.

TABLE 2

| Mixed powder No. | Iron-based powder Type* | Powder for alloy Type | Powder for alloy Content** % by mass | Powder for improving machinability Type | Powder for improving machinability Content** in terms of Ca % by mass | Lubricant Type | Lubricant Content*** parts by weight |
|---|---|---|---|---|---|---|---|
| 2-1 | e | Graphite powder | 0.7 | — | — | Zinc stearate | 0.4 |
| 2-2 | e | Graphite powder | 0.7 | Tricalcium phosphate | 0.13 | Zinc stearate | 0.4 |
| 2-3 | e | Graphite powder | 0.7 | Tricalcium phosphate | 0.19 | Zinc stearate | 0.6 |
| 2-4 | e | Graphite powder Cu powder | 0.8 2.0 | Tricalcium phosphate | 0.22 | Zinc stearate | 0.4 |

TABLE 2-continued

| | | | | | | | |
|---|---|---|---|---|---|---|---|
| 2-5 | e | Graphite powder<br>Cu powder | 0.8<br>2.0 | Tricalcium phosphate | 0.22 | Zinc stearate | 0.6 |
| 2-6 | e | Graphite powder<br>Cu powder | 0.8<br>2.0 | Tricalcium phosphate<br>Calcium monohydrogen phosphate | 0.06<br>0.06 | Zinc stearate | 0.7 |
| 2-7 | e | Graphite powder<br>Cu powder | 0.8<br>2.0 | Tricalcium phosphate<br>Calcium dihydrogen phosphate | 0.10<br>0.09 | Zinc stearate | 0.6 |
| 2-8 | e | Graphite powder<br>Cu powder | 0.8<br>2.0 | Calcium monohydrogen phosphate | 0.21 | Zinc stearate | 0.6 |
| 2-9 | e | Graphite powder<br>Cu powder | 0.8<br>2.0 | Calcium dihydrogen phosphate | 0.21 | Zinc stearate | 0.75 |

| | | Properties of sintered compact | | | | |
|---|---|---|---|---|---|---|
| Mixed powder No. | Green compact Density $Mg/m^3$ | Radial crushing strength Mpa | Machinability Number of bores | Rate of dimensional change % | Appearance of sintered compact | Remarks |
| 2-1 | 6.74 | 400 | 7 | 0.11 | Good | Comparative Example |
| 2-2 | 6.75 | 390 | 360 | 0.13 | Good | Example of this invention |
| 2-3 | 6.72 | 350 | 520 | 0.15 | Good | Example of this invention |
| 2-4 | 6.75 | 780 | 206 | 0.30 | Good | Example of this invention |
| 2-5 | 6.74 | 770 | 210 | 0.27 | Good | Example of this invention |
| 2-6 | 6.71 | 765 | 205 | 0.16 | Good | Example of this invention |
| 2-7 | 6.75 | 770 | 340 | 0.20 | Good | Example of this invention |
| 2-8 | 6.73 | 780 | 320 | 0.26 | Good | Example of this invention |
| 2-9 | 6.72 | 770 | 215 | 0.27 | Good | Example of this invention |

*e: Water-atomized iron powder (subjected segregation-free treatment)

**Based on the total of (iron-based powder + powder for alloy + powder for improving machinability)

***Based on the total of 100 parts by weight of (iron-based powder + powder for alloy + powder for improving machinability)

In all examples of this invention, the green compacts have a high density, the sintered compacts have high radial crushing strength and a low rate of dimensional change in the outer diameter, and sintered compacts having a large number of bores and excellent machinability can be formed. Therefore, the iron-based mixed powders have excellent properties as an iron-based mixed powders for powder metallurgy.

On the other hand, in the comparative examples, machinability deteriorates.

The composition of the water-atomized iron powder (symbol e in Table 2) was substantially the same as the water-atomized iron powder (symbol a) of Example 1. The compositions of the iron-based mixed powders and the sintered compacts exhibited the same tendency as Example 1.

Example 3

First Embodiment

A water-atomized iron powder (trade name: KIP®301 A produced by Kawasaki Steel Corporation) was used as the iron-based powder. A mixture of a natural graphite powder (average particle diameter: 4 μm) and an electrolytic copper powder (average particle diameter: 35 μm) used as the powder for an alloy in the amount (% by mass) based on the total amount of the iron-based powder, the powder for an alloy and the machinability improving powder shown in Table 3; at least one of a tricalcium phosphate powder (maximum particle diameter: 45 μm, average particle diameter: 20 μm) and a calcium fluoride (maximum particle diameter: 30 μm, average particle diameter: 15 μm) used as the machinability improving powder in the mixing amount (% by mass) shown in Table 3; and zinc stearate (average particle diameter: 20 μm) used as the lubricant in the amount (parts by weight) based on the total amount of 100 parts by weight of the iron-based powder, the powder for an alloy and the machinability improving powder shown in Table 3 were added to 100 Kg of the iron-based powder in a V-blender, followed by primary mixing to form a iron-based mixed powder. The iron-based mixed powders included an iron-based mixed powder containing a hydroxyapatite powder (average particle diameter: 16 μm) added as the machinability improving powder, and an iron-based mixed powder containing no machinability improving powder.

Then, a die(mold) was filled with each of the thus-formed iron-based mixed powders, and pressing was carried out so that the density of a green compact was 6.8 $Mg/m^3$ to form a ring-shaped specimen of green compact with outer diameter 60 mm×inner diameter 20 mm×height 30 mm for a turning test. The specimen of green compact was sintered at 1130° C. for 20 minutes in a RX gas atmosphere by using the mesh belt furnace to form sintered compacts.

Each of the sintered compacts (specimens) was subjected to the turning test using a NC machining center. The turning test was carried out under conditions of a machining speed of 100 m/min and a cutting thickness of 0.4 mm by using a cermet tool (produced by Toshiba Tungaloy Co., Ltd.).

The specimen was cut by 5000-m turning at the most under observation of the tool tip by a profile projector with a magnification of ×50 at each time of 1000-m turning to measure the amount of flank wear of the tool. The amount of flank wear was measured according to JIS B 4011, and represented an amount of wearing of the tool after the test. After the test, the cut surface of each specimen was visually observed to measure the presence of luster of the appearance. The results are shown in Table 3.

TABLE 3

| | | | | Powder for improving machinability | | |
|---|---|---|---|---|---|---|
| | Iron- | Powder for alloy | | | Content** | FC |
| Mixed powder No. | based powder Type* | Type | Content** % by mass | Type | in terms of Ca % by mass | value*** (in terms of Ca) |
| 3-1 | f | Cu powder<br>Graphite powder | 1.5<br>0.8 | — | — | — |
| 3-2 | f | Cu powder<br>Graphite powder | 1.5<br>0.8 | Tricalcium phosphate | 0.17 | — |
| 3-3 | f | Cu powder<br>Graphite powder | 1.5<br>0.8 | Tricalcium phosphate<br>Calcium fluoride | 0.17<br>0.05 | 0.29 |
| 3-4 | f | Cu powder<br>Graphite powder | 1.5<br>0.8 | Tricalcium phosphate<br>Calcium fluoride | 0.28<br>0.05 | 0.18 |
| 3-5 | f | Cu powder<br>Graphite powder | 1.5<br>0.8 | Tricalcium phosphate<br>Calcium fluoride | 0.06<br>0.10 | 1.67 |
| 3-6 | f | Cu powder<br>Graphite powder | 1.5<br>0.8 | Tricalcium phosphate<br>Calcium fluoride | 0.06<br>0.15 | 2.50 |
| 3-7 | f | Cu powder<br>Graphite powder | 1.5<br>0.8 | Tricalcium phosphate<br>Calcium fluoride | 0.17<br>0.15 | 0.88 |
| 3-8 | f | Cu powder<br>Graphite powder | 1.5<br>0.8 | Tricalcium phosphate<br>Calcium fluoride | 0.06<br>0.21 | 3.50 |
| 3-9 | f | Cu powder<br>Graphite powder | 1.5<br>0.8 | Tricalcium phosphate<br>Calcium fluoride | 0.11<br>0.21 | 1.91 |
| 3-10 | f | Cu powder<br>Graphite powder | 1.5<br>0.8 | Tricalcium phosphate<br>Calcium fluoride | 0.06<br>0.26 | 4.33 |
| 3-11 | f | Cu powder<br>Graphite powder | 1.5<br>0.8 | Tricalcium phosphate<br>Calcium fluoride<br>Hydroxyapatite | 0.02<br>0.15<br>0.02 | 3.75 |

| | Lubricant | | Green | Machinability | Sintered compact | |
|---|---|---|---|---|---|---|
| Mixed Powder No. | Type | Content**** parts by weight | compact Density $Mg/m^3$ | Flank wear mm | Appearance of cut surface | Remarks |
| 3-1 | Zinc stearate | 1.0 | 6.8 | 0.80 | Luster | Comparative Example |
| 3-2 | Zinc stearate | 1.0 | 6.8 | 0.60 | No luster | Example of this invention |
| 3-3 | Zinc stearate | 1.0 | 6.8 | 0.59 | No luster | Example of this invention |

TABLE 3-continued

| | | | | | | |
|---|---|---|---|---|---|---|
| 3-4 | Zinc stearate | 1.0 | 6.8 | 0.55 | No luster | Example of this invention |
| 3-5 | Zinc stearate | 1.0 | 6.8 | 0.52 | Luster | Example of this invention |
| 3-6 | Zinc stearate | 1.0 | 6.8 | 0.41 | Luster | Example of this invention |
| 3-7 | Zinc stearate | 1.0 | 6.8 | 0.35 | Luster | Example of this invention |
| 3-8 | Zinc stearate | 1.0 | 6.8 | 0.35 | Luster | Example of this invention |
| 3-9 | Zinc stearate | 1.0 | 6.8 | 0.35 | Luster | Example of this invention |
| 3-10 | Zinc stearate | 1.0 | 6.8 | 0.31 | Luster | Example of this invention |
| 3-11 | Zinc stearate | 1.0 | 6.8 | 0.4 | Luster | Example of this invention |

*f: Water-atomized powder

**Based on the total of (iron-based powder + powder for alloy + powder for improving machinability)

***FC value (in terms of Ca) = (content of calcium fluoride)/(content of calcium phosphate compounds)

****Based on the total of 100 parts by weight of (iron-based powder + powder for alloy + powder for improving machinability)

In all examples of this invention, the sintered compacts show a small amount of flank wear, and excellent machinability. Particularly, in the examples of this invention in which the ratio of the amount of calcium fluoride to the amount (total) of tricalcium phosphate compound, i.e., the FC value, is about 0.8 or more, the amounts of flank wearing are further decreased, and the sintered compacts have the lustrous cut surfaces and excellent appearances.

On the other hand, in the comparative example out of the range of the invention, the amount of flank wear is large, and the sintered compact has poor machinability.

The composition of the water-atomized iron powder (symbol f in Table 3) was the same as the water-atomized iron powder (symbol a in Table 1) of Example 1. The compositions of the iron-based mixed powders and the sintered compacts showed the same tendency as Example 1.

Example 4

First Embodiment

A reduced iron powder made from a mill scale(trade name: KIP®255 M produced by Kawasaki Steel Corporation) was used as the iron-based powder. A mixture of a graphite powder (average particle diameter: 5 μm or nickel powder caverage particle size; 4 μm) and a water-atomized copper powder (containing 70% or more of particles having an average particle diameter of 45 μm or less) used as the powder for an alloy in the amount (% by mass) based on the total amount of the iron-based powder, the powder for an alloy and the machinability improving powder shown in Table 4; at least one of a hydroxyapatite powder and calcium fluoride powder (average particle diameters of 20 μm and 18 μm, respectively) used as the machinability improving powder in the mixing amount (% by mass) shown in Table 4; and zinc stearate (average particle diameter: 20 μm) used as the lubricant in the amount (part by weight) based on the total amount of 100 parts by weight of the iron-based powder, the powder for an alloy and the machinability improving powder shown in Table 4 were added to 100 Kg of the iron-based powder in a V-blender, followed by primary mixing to form an iron-based mixed powder.

Then, a die(mold) was filled with each of the thus-formed iron-based mixed powders, and pressing was carried out at a compacting pressure of 624 to 655 MPa to form ring-shaped specimen of green compacts with outer diameter 35 mm×inner diameter 14 mm×height 10 mm for a radial crushing test and a test for measuring the rate of dimensional change in the outer diameter, a disk-shaped specimen product of outer diameter 60 mm×height 10 mm for a drilling test, and a rectangular green compact of 10×10×55 mm. The density of the rectangular green compacts controlled to 6.8 $Mg/m^3$ was measured by the Archimedes method.

These specimen of green compacts were sintered at 1130° C. for 20 minutes in the RX gas atmosphere by using the mesh belt furnace to form sintered compacts.

Each of the sintered compacts (specimens) was subjected to the radial crushing test according to JIS Z 2507 and the test for measuring a rate of dimensional change in the outer diameter, and the drilling test under conditions including a revolution speed of 10000 rpm and a feed of 0.012 mm/rev to determine radial crushing strength ($N/mm^2$), the rate of dimensional change in the outer diameter and the machinabilily (number of bores). The radial crushing strength ($N/nm^2$) was determined according to JIS Z 2507. The rate of dimensional change in the outer diameter was determined by measuring the outer diameter of the ring-shaped specimen based on the outer diameter of the die(mold) after sintering to determine the rate of change relative to the outer diameter of the die(mold) (={(average diameter of the ring-shaped specimen after sintering—outer diameter of the die(mold))/(outer diameter of the die(mold))}×100%). This rate of change was considered as the rate of dimensional change in the outer diameter. The number of bores was the number of the bores formed until a drill (made of high-speed steel, 1.2 mmø) was chipped.

The results are shown in Table 4.

TABLE 4

| | Iron-based powder | Powder for alloy | | Powder for improving machinability | | | Lubricant | |
|---|---|---|---|---|---|---|---|---|
| No. | Type | Type | Content* % by mass | Type | Crystallite size | Ca content* % by mass | Type | Content** % by mass |
| 4-1 | 255M | Cu powder<br>Graphite powder | 1.5<br>0.7 | No addition | | | Zinc stearate | 0.75 |
| 4-2 | 255M | Cu powder<br>Graphite powder | 1.5<br>0.7 | Hydroxyapatite | 190 | 0.12 | Zinc stearate | 0.75 |
| 4-3 | 255M | Cu powder<br>Graphite powder | 1.5<br>0.7 | Hydroxyapatite | 220 | 0.12 | Zinc stearate | 0.75 |
| 4-4 | 255M | Cu powder<br>Graphite powder | 1.5<br>0.7 | Hydroxyapatite | 450 | 0.12 | Zinc stearate | 0.75 |
| 4-5 | 255M | Cu powder<br>Graphite powder | 1.5<br>0.7 | Hydroxyapatite | 610 | 0.12 | Zinc stearate | 0.75 |
| 4-6 | 255M | Cu powder<br>Graphite powder | 1.5<br>0.7 | Hydroxyapatite | 690 | 0.12 | Zinc stearate | 0.75 |
| 4-7 | 255M | Cu powder<br>Graphite powder | 1.5<br>0.7 | Hydroxyapatite | 880 | 0.12 | Zinc stearate | 0.75 |
| 4-8 | 255M | Cu powder<br>Graphite powder | 1.5<br>0.7 | Hydroxyapatite | 880 | 0.28 | Zinc stearate | 0.75 |
| 4-9 | 255M | Cu powder<br>Graphite powder | 1.5<br>0.7 | Hydroxyapatite | 880 | 0.39 | Zinc stearate | 0.75 |
| 4-10 | 255M | Cu powder<br>Graphite powder | 1.5<br>0.7 | Hydroxyapatite | 880 | 0.52 | Zinc stearate | 0.75 |
| 4-11 | 255M | Cu powder<br>Graphite powder | 1.5<br>0.7 | Hydroxyapatite<br>$CaF_2$ | 880<br>— | 0.12<br>0.10 | Zinc stearate | 0.75 |
| 4-12 | 255M | Cu powder<br>Graphite powder | 1.5<br>0.7 | MnS | | 0.50 | Zinc stearate | 0.75 |
| 4-13 | 255M | Cu powder<br>Ni powder | 0.5<br>0.5 | Hydroxyapatite | 880 | 0.35 | Zinc stearate | 0.75 |

| | Properties of sintered compact | | | | |
|---|---|---|---|---|---|
| No. | Radial crushing strength Mpa | Machinability Number of bores | Rate of dimensional change % | Appearance of sintered compact | Remarks |
| 4-1 | 746 | 7 | 0.19 | Good | Comparative Example |
| 4-2 | 640 | 75 | 0.25 | Good | Example of this invention |
| 4-3 | 665 | 105 | 0.17 | Good | Example of this invention |
| 4-4 | 670 | 141 | 0.16 | Good | Example of this invention |
| 4-5 | 710 | 210 | 0.15 | Good | Example of this invention |
| 4-6 | 740 | 380 | 0.13 | Good | Example of this invention |
| 4-7 | 745 | 560 | 0.13 | Good | Example of this invention |
| 4-8 | 742 | 760 | 0.17 | Good | Example of this invention |
| 4-9 | 740 | 770 | 0.18 | Good | Example of this invention |
| 4-10 | 680 | 799 | 0.20 | Good | Example of this invention |
| 4-11 | 741 | 582 | 0.15 | Good | Example of this invention |
| 4-12 | 722 | 108 | 0.24 | Adhesion of soot | Conventional Example |
| 4-13 | 850 | 205 | 0.10 | Good | Example of this invention |

*Based on the total of (iron-based powder + powder for alloy + powder for improving machinability)
**Based on the total of 100 parts by weight of (iron-based powder + powder for alloy + powder for improving machinability)

In the examples of this invention, especially the examples satisfying preferable conditions, the sintered compacts have high crushing strength, low rates of dimensional change in the outer diameters, and a large number of bores and excellent machinability and, thus, the iron-based mixed powders of this invention have excellent properties as iron-based mixed powders for powder metallurgy.

On the other hand, in the comparative examples and conventional example out of the range of the invention, the green compacts have a low machinability or soot on its surface.

The composition of the reduced iron powder (KIP®255M) was substantially the same as the reduced iron powder (symbol b in Table 1) of Example 1. The compositions of the iron-based mixed powders and the sintered compacts exhibited the same tendency as Example 1.

Example 5

First Embodiment

A water-atomized iron powder (trade name: KIP®301 A produced by Kawasaki Steel Corporation) was used as the iron-based powder. A mixture of a natural graphite powder (average particle diameter: 5 μm) and an electrolytic copper powder (average particle diameter: 35 μm) used as the powder for an alloy in the amount (% by mass) based on the total amount of the iron-based powder, the powder for an alloy and the machinability improving powder shown in Table 5; at least one of a hydroxyapatite powder and calcium fluoride powder (average particle diameters of 18 μm and 23 μm, respectively) used as the machinability improving powder in the mixing amount (% by mass) shown in Table 5; and zinc stearate (melting point; 120° C.) used as the binder in an amount of 0.4 part by weight based on the total amount of 100 parts by weight of the iron-based powder, the powder for an alloy and the machinability improving powder were added to 100 Kg of the iron-based powder, followed by primary mixing.

Then, the resultant mixture was heated to 120° C. to melt the binder under mixing, and then cooled to fix the powder for an alloy and/or the machinability improving powder to the surfaces of the iron-based powder, to form an iron-based powder subjected to segregation-free treatment. Furthermore, zinc stearate (average particle diameter: 20 μm) as the lubricant was added in the amount (parts by weight) based on the total amount of 100 parts by weight of the iron-based powder, the powder for an alloy and the machinability improving powder shown in Table 5, and uniformly mixed to form an iron-based mixed powder.

As in Example 4, a die(mold) was filled with each of the thus-formed iron-based mixed powders, and compression pressing was carried out at compacting pressure of 590 MPa to form ring-shaped specimen of green compacts with outer diameter 35 mm×inner diameter 14 mm×height 10 mm for a radial crushing test and a test for measuring a rate of dimensional change in the outer diameter, a disk-shaped specimen of green compact with outer diameter 60 mm×height 10 mm for a drilling test, and a rectangular green compact of 10×10×55 mm.

The specimen of green compacts were sintered at 1130° C. for 15 minutes in the RX gas atmosphere by using the mesh belt furnace to form sintered compacts.

Each of the sintered compacts (specimens) was subjected to the crushing test, the test for measuring a rate of dimensional change in the outer diameter, and the drilling test by the same method as Example 4 to determine radial crushing strength ($N/mm^2$), the rate of dimensional change in the outer diameter and the number of bores. The results are shown in Table 5.

TABLE 5

| | | | | Powder for improving machinability | | | | |
|---|---|---|---|---|---|---|---|---|
| | Iron-based powder | Powder for alloy | | | | Ca | Lubricant | |
| No. | Type | Type | Content* % by mass | Type | Crystallite size | content* % by mass | Type | Content** % by mass |
| 5-1 | 301A | Cu powder | 1.5 | No addition | | | Zinc stearate | 0.75 |
| | | Graphite powder | 0.8 | | | | | |
| 5-2 | 301A | Cu powder | 1.5 | Hydroxyapatite | 450 | 0.12 | Zinc stearate | 0.75 |
| | | Graphite powder | 0.8 | | | | | |
| 5-3 | 301A | Cu powder | 1.5 | Hydroxyapatite | 610 | 0.12 | Zinc stearate | 0.75 |
| | | Graphite powder | 0.8 | | | | | |
| 5-4 | 301A | Cu powder | 1.5 | Hydroxyapatite | 690 | 0.12 | Zinc stearate | 0.75 |
| | | Graphite powder | 0.8 | | | | | |
| 5-5 | 301A | Cu powder | 1.5 | Hydroxyapatite | 880 | 0.12 | Zinc stearate | 0.75 |
| | | Graphite powder | 0.8 | | | | | |
| 5-6 | 301A | Cu powder | 1.5 | Hydroxyapatite | 880 | 0.28 | Zinc stearate | 0.75 |
| | | Graphite powder | 0.8 | | | | | |
| 5-7 | 301A | Cu powder | 1.5 | Hydroxyapatite | 880 | 0.39 | Zinc stearate | 0.75 |
| | | Graphite powder | 0.8 | | | | | |
| 5-8 | 301A | Cu powder | 1.5 | Hydroxyapatite | 880 | 0.52 | Zinc stearate | 0.75 |
| | | Graphite powder | 0.8 | | | | | |
| 5-9 | 301A | Cu powder | 1.5 | Hydroxyapatite | 880 | 0.12 | Zinc stearate | 0.75 |
| | | Graphite powder | 0.8 | $CaF_2$ | — | 0.10 | | |
| 5-10 | 301A | Cu powder | 1.5 | MnS | | 0.50 | Zinc stearate | 0.75 |
| | | Graphite powder | 0.8 | | | | | |
| 5-11 | 301A | Cu powder | 1.5 | Hydroxyapatite | 880 | 0.39 | Zinc stearate | 0.70 |
| | | Graphite powder | 0.8 | | | | | |

TABLE 5-continued

| No. | Properties of sintered compact: Radial crushing strength Mpa | Machinability Number of bores | Rate of dimensional change % | Appearance of sintered compact | Remarks |
|---|---|---|---|---|---|
| 5-1 | 770 | 9 | 0.23 | Good | Comparative Example |
| 5-2 | 755 | 205 | 0.30 | Good | Example of this invention |
| 5-3 | 761 | 290 | 0.28 | Good | Example of this invention |
| 5-4 | 764 | 511 | 0.22 | Good | Example of this invention |
| 5-5 | 771 | 751 | 0.21 | Good | Example of this invention |
| 5-6 | 752 | 1010 | 0.23 | Good | Example of this invention |
| 5-7 | 734 | 1042 | 0.24 | Good | Example of this invention |
| 5-8 | 670 | 1088 | 0.25 | Good | Example of this invention |
| 5-9 | 755 | 781 | 0.20 | Good | Example of this invention |
| 5-10 | 745 | 98 | 0.29 | Adhesion of soot | Conventional Example |
| 5-11 | 740 | 1015 | 0.22 | Good | Example of this invention |

*Based on the total of (iron-based powder + powder for alloy + powder for improving machinability)

**Based on the total of 100 parts by weight of (iron-based powder + powder for alloy + powder for improving machinability)

In all examples of this invention, especially the examples satisfying preferable conditions, the sintered compacts have high radial crushing strength and low rates of dimensional change in the outer diameters and a large number of bores as compared with the product containing no machinability improving powder and, thus, sintered compacts having excellent machinability can be formed. Also, the iron-based mixed powders have excellent properties as iron-based mixed powders for powder metallurgy.

On the other hand, in the comparative examples out of the range of the present invention, radial crushing strength is low to deteriorate machinability.

The composition of the water-atomized iron powder (KIP®301A) was substantially the same as the water-atomized iron powder (symbol a in Table 1) of Example 1. The compositions of the iron-based mixed powders and the sintered compacts exhibited the same tendency as Example 1.

Example 6

Second Embodiment

A water-atomized iron powder (trade name: KIP®301 A produced by Kawasaki Steel Corporation) was used as the iron-based powder. A mixture of a graphite powder (average particle diameter: 23 $\mu$m) and an electrolytic copper powder (average particle diameter: 25 $\mu$m) used as the powder for an alloy, the machinability improving powder (average particle diameter: 12 to 28 $\mu$m) of the type shown in Table 6, and the binder of the type shown in Table 6 were added to 1 Kg of the iron-based powder in a heating blender, and sufficiently mixed. The amounts of the powder for an alloys and the machinability improving powder mixed were the amounts (% by mass) based on the total amount of the iron-based powder, the powder for an alloy and the machinability improving powder shown in Table 6. The amount of the binder was the amount (parts by weight) based on the total amount of 100 parts by weight of the iron-based powder, the powder for an alloy and the machinability improving powder shown in Table 6.

Then, the resultant mixture was heated, under mixing, to the temperature shown in Table 6 based on the minimum and maximum melting points of the binders mixed (primary mixing) to form a primary mixture. Then, the mixture was cooled to 85° C. or less under mixing.

Furthermore, the primary mixture was cooled to 40° C., and the lubricant (free lubricant) of the type shown in Table 6 was added to the primary mixture. The amount of the lubricant added was as shown in Table 6. The resultant mixture was then uniformly mixed (secondary mixing), and discharged from the heating blender. The amount of the free lubricant mixed was the amount (parts by weight) based on the total amount of 100 parts by weight of the iron-based powder, the powder for an alloy and the machinability improving powder shown in Table 6.

Table 7 shows the symbols and types of the lubricants other than a thermoplastic resin powder, zinc stearate and lithium stearate added in secondary mixing. Table 8 shows the symbols and types, the compositions, the polymerization methods, the primary particle diameters, the agglomerated average particle diameters and the molecular weights of the thermoplastic resin powders used in secondary mixing.

As comparative examples, an iron-based mixed powder (No. 6-12) containing no machinability improving powder, an iron-based mixed powder (No. 6-15) containing MnS as the machinability improving powder (Conventional Example) were prepared. Also, in a comparative example (iron-based mixed powder No. 6-14), the mixture was mixed at room temperature for 30 minutes with the V-blender without using the binder, and in an example of this invention (iron-based mixed powder No. 6-17), the binder (polyvinyl alcohol; PVB) was dissolved in an organic solvent (isopropyl alcohol), and then evaporated to fix the powder for an alloy and the machinability improving powder to the iron-based powder.

Each of the iron-based mixed powders was examined with respect to the degrees of adhesion of the graphite powder, and the alkali earth metal fluoride powder. The powder of 200 mesh or more and the powder of 100 mesh or less were sieved out from each of the iron-based mixed powders, and the C contents and F contents of these powders and the whole iron-based mixed powder were determined by analysis. Then, the degree of adhesion was calculated by the following equations (1) and (2):

The degree of adhesion of the graphite powder was calculated by the following equation (1):

Degree of adhesion of graphite powder=(C content of the powders having a particle size of 200 mesh or more and 100 mesh or less)/(C content of the whole iron-based mixed powder) (1)

The degree of adhesion of the machinability improving powder was calculated by the following equation (2):

Degree of adhesion of machinability improving powder=(F content of the powders having particle sizes of 200 mesh or more and 100 mesh or less)/(F content of the whole iron-based mixed powder) (2)

Then, a die(mold) was filled with each of the thus-formed iron-based mixed powders, and pressing was carried out at compacting pressure of 480 MPa to a disk-shaped specimen of green compact with outer diameter 60 mm x height 10 mm for a drilling test, and a rectangular green compact of 10×10×55 mm.

The density of the rectangular green compact was measured by the Archimedes method.

The specimen green compacts were sintered at 1130° C. for 20 minutes in the RX gas atmosphere by using the mesh belt furnace to form sintered compacts.

Each of the sintered compacts (specimens) was subjected to the drilling test under the conditions including a revolution speed of 10000 rpm and a feed of 0.012 mm/rev to determine the number of bores. The number of the bores formed until the drill (high speed steel 1.2 mmø) was chipped was used as index of machinability.

The results are shown in Table 9.

TABLE 6

| Iron-based mixed powder No. | Powder for alloy**** % by mass: Copper powder | Powder for alloy**** % by mass: Graphite powder | Powder for improving machinability: Type | Powder for improving machinability: Content**** % by mass | Powder for improving machinability: Particle diameter μm | Primary mixing heating temperature ° C. | Binder: Stearic acid Melting point: 69° C. Parts by weight | Binder: Oleamide Melting point: 76° C. Parts by weight | Binder: Stearamid Melting point: 103° C. Parts by weight | Binder: Melted mixture of Stearamid and Ethylenbis (stearamide) Melting point: 125° C. Parts by weight |
|---|---|---|---|---|---|---|---|---|---|---|
| 6-1 | 2.0 | 0.75 | $CaF_2$ | 0.15 | 10 | 135 | — | — | — | 0.20 |
| 6-2 | 2.0 | 0.75 | $CaF_2$ | 0.30 | 15 | 110 | 0.20 | — | — | 0.10 |
| 6-3 | 2.0 | 0.75 | $CaF_2$ | 0.40 | 25 | 86 | — | 0.40 | — | — |
| 6-4 | 2.0 | 0.75 | $CaF_2$ | 0.50 | 10 | 120 | — | — | 0.80 | — |
| 6-5 | 2.0 | 0.75 | $CaF_2$ | 0.65 | 35 | 135 | — | — | — | 0.50 |
| 6-6 | 2.0 | 0.75 | $MgF_2$ | 0.30 | 25 | 140 | — | — | — | 0.20 |
| 6-7 | 2.0 | 0.75 | $MgF_2$ | 0.50 | 20 | 115 | — | — | 0.20 | 0.20 |
| 6-8 | 2.0 | 0.75 | $SrF_2$ | 0.30 | 15 | 110 | — | 0.20 | — | 0.20 |
| 6-9 | 2.0 | 0.75 | $SrF_2$ | 0.50 | 20 | 96 | — | 0.20 | 0.20 | — |
| 6-10 | 2.0 | 0.75 | $BaF_2$ | 0.30 | 26 | 120 | 0.25 | — | — | — |
| 6-11 | 2.0 | 0.75 | $BaF_2$ | 0.50 | 30 | 96 | — | 0.30 | 0.30 | — |
| 6-12 | 2.0 | 0.75 | — | — | — | 90 | 0.20 | — | 0.30 | — |
| 6-13 | 2.0 | 0.75 | $CaF_2$ | 0.90 | 25 | 110 | 0.20 | — | — | — |
| 6-14 | 2.0 | 0.75 | $CaF_2$ | 0.50 | 10 | RT* | — | — | — | — |
| 6-15 | 2.0 | 0.75 | MnS | 0.50 | 24 | 100 | — | 0.15 | — | — |
| 6-16 | ******0.5 Ni | 0.5 | $CaF_2$ | 0.45 | 35 | 120 | — | — | 0.8 | — |
| 6-17 | 2 | 0.75 | $CaF_2$ | 0.5 | 10 | — | — | — | — | — |

| Iron-based mixed powder No. | Binder: Ethylenbis (stearamide) Melting point: 142° C. Parts by weight | Binder: Total***** Parts by weight | Free lubricant: Type: Content (Parts by weight): Thermoplastic resin powder**: Type | Thermoplastic resin powder**: Content | Zinc stearate | Lithium stearate | Total***** Parts by weight | Type:** Content***** Parts by weight | Total***** Parts by weight |
|---|---|---|---|---|---|---|---|---|---|
| 6-1 | 0.25 | 0.45 | — | — | 0.20 | — | 0.20 | — | 0.20 |
| 6-2 | — | 0.30 | C | 0.25 | 0.20 | — | 0.45 | — | 0.45 |
| 6-3 | — | 0.40 | F | 0.10 | 0.10 | — | 0.20 | e: 0.20 | 0.40 |

TABLE 6-continued

| | | | | | | | | | |
|---|---|---|---|---|---|---|---|---|---|
| 6-4 | — | 0.80 | G | 0.20 | 0.20 | — | 0.40 | f: 0.10 | 0.50 |
| 6-5 | — | 0.50 | — | — | — | 0.10 | 0.10 | a: 0.40 | 0.50 |
| 6-6 | 0.20 | 0.40 | B | 0.10 | 0.20 | 0.05 | 0.35 | c: 0.15 | 0.50 |
| 6-7 | — | 0.40 | C | 0.25 | — | — | 0.25 | f: 0.15 | 0.40 |
| 6-8 | — | 0.40 | D | 0.20 | 0.20 | — | 0.40 | b: 0.10, d: 0.20 | 0.70 |
| 6-9 | — | 0.40 | A | 0.15 | — | 0.25 | 0.40 | — | 0.40 |
| 6-10 | 0.40 | 0.65 | E | 0.10 | 0.10 | — | 0.20 | e: 0.20 | 0.40 |
| 6-11 | — | 0.60 | E | 0.20 | — | — | 0.20 | — | 0.20 |
| 6-12 | — | 0.50 | B | 0.10 | — | — | 0.10 | c: 0.30 | 0.40 |
| 6-13 | 0.20 | 0.40 | — | — | 0.20 | — | 0.20 | d: 0.10 | 0.30 |
| 6-14 | — | — | — | — | 0.75 | — | 0.75 | — | 0.75 |
| 6-15 | 0.50 | 0.65 | — | — | 0.15 | — | 0.15 | f: 0.20 | 0.35 |
| 6-16 | — | 0.8 | G | 0.2 | 0.2 | — | 0.4 | f: 0.1 | 0.5 |
| 6-17 | — | ********PVB0.1 | — | — | 0.70 | — | 0.70 | — | 0.70 |

*Mixing with a V-shaped blender
**Refer to Table 7
***Refer to Table 8
****Based on the total of (iron-based powder + powder for alloy + powder for improving machinability)
*****Based on the total of 100 parts by weight of (iron-based powder + powder for alloy + powder for improving machinability)
******0.5 mass % nickel powder instead of copper powder
*******Polyvinyl alcohol of 0.1 parts by weight

TABLE 7

| Symbol | Type |
|---|---|
| a | Stearic acid |
| b | Oleamide |
| c | Stearamide |
| d | Melted mixture of steamide and ethylenebis(stearamid) |
| e | Ethylenebis(stearamid) |

TABLE 7-continued

| Symbol | Type |
|---|---|
| f | Polyethylene having a molecular weight of 10,000 or less, or a melted mixture of ethylenebis(stearamid) and polyethylene having a molecular weight of 10,000 or less |

TABLE 8

| Symbol of thermoplastic resin powder type | Condition for producing thermoplastic resin powder: Composition* | Composition ratio % by weight | Polymerization method | Properties of thermoplastic resin powder: Average molecular weight (tethousand) | Primary particle diameter μm | Agglomerated particle diameter μm |
|---|---|---|---|---|---|---|
| A | MMA | 100 | Copolymerization | 40 | 0.04 | 30 |
| B | BA/MMA | 60/40 | Core-shell two-step polymenization | 200 | 1 | 40 |
| C | ST/BMA | 70/30 | Copolymerization | 300 | 3 | 25 |
| D | MMA/BD | 85/15 | Copolymerization | 80 | 0.08 | 15 |
| E | MMA/BMA | 70/30 | Copolymerization | 60 | 0.4 | 30 |
| F | ST/AN | 80/20 | Copolymerization | 100 | 0.3 | 20 |
| G | EA/ST | 60/40 | Core-shell two-step polymenization | 250 | 0.1 | 15 |

MMA: Methyl methacrylate
BMA: n-Butyl methacrylate
EA: Ethyl acrylate
BA: n-Butyl acrylate
AN: Acrylonitrile
BD: Butadiene
ST: Styrene

TABLE 9

| Iron-based mixed powder No. | Degree of adhesion: Graphite powder % | Degree of adhesion: Powder for improving machinability* % | Green compact Density Mg/m$^3$ | Properties of sintered compact: Machinability Number of bores | Properties of sintered compact: Appearance of sintered compact | Remarks |
|---|---|---|---|---|---|---|
| 6-1 | 85 | 87 | 6.88 | 520 | Good | Example of this invention |
| 6-2 | 83 | 84 | 6.85 | 630 | Good | Example of this invention |
| 6-3 | 83 | 75 | 6.84 | 750 | Good | Example of this invention |
| 6-4 | 84 | 83 | 6.84 | 880 | Good | Example of this invention |
| 6-5 | 83 | 70 | 6.82 | 820 | Good | Example of this invention |
| 6-6 | 84 | 78 | 6.84 | 450 | Good | Example of this invention |
| 6-7 | 86 | 79 | 6.83 | 480 | Good | Example of this invention |
| 6-8 | 82 | 81 | 6.85 | 510 | Good | Example of this invention |
| 6-9 | 84 | 80 | 6.83 | 540 | Good | Example of this invention |
| 6-10 | 83 | 76 | 6.85 | 490 | Good | Example of this invention |
| 6-11 | 86 | 73 | 6.82 | 530 | Good | Example of this invention |
| 6-12 | 83 | — | 6.86 | 5 | Good | Comparative Example |
| 6-13 | 81 | 72 | 6.74 | 860 | Good | Example of this invention |
| 6-14 | 25 | 32 | 6.87 | 250 | Good | Comparative Example |
| 6-15 | 83 | — | 6.83 | 830 | Adhesion of soot | Conventional Example |
| 6-16 | 82 | 71 | 6.82 | 340 | Good | Example of this invention |
| 6-17 | 75 | 68 | 6.84 | 870 | Good | Example of this invention |

*Fluoride of alkali earth metal

In all examples of this invention, especially examples satisfying preferable conditions, the green compacts have a high density, the degrees of adhesion of the graphite powder and the machinability improving powder are high, and the number of bores are large. Therefore, sintered compacts having excellent machinability can be formed, and iron-based mixed powders have excellent properties for powder metallurgy.

On the other hand, in the comparative examples out of the range of the present invention, the green compacts have a low machinability. Also, in the iron-based mixed powder (No. 6-15) (Conventional Example) containing the S-containing machinability improving powder, defects were observed in the appearance of the sintered compact.

The composition of the water-atomized iron powder (KIP®301A) was substantially the same as the water-atomized iron powder (symbol a Table 1) of Example 1. The compositions of the iron-based mixed powders and the sintered compacts exhibited the same tendency as Example 1.

Example 7

Second Embodiment

A water-atomized iron powder (trade name: KIP®301 A produced by Kawasaki Steel Corporation) was used as the iron-based powder. A mixture of a graphite powder (average particle diameter: 23 μm) and an electrolytic copper powder (average particle diameter: 25 μm) used as the powder for an alloy, and the machinability improving powder (average particle diameter: 7 to 20 μm) of the type shown in Table 10 were added to 1 Kg of the iron-based powder, and at least one selected as the binder from oleic acid, spindle oil and turbine oil shown in Table 10 was sprayed on the resultant mixture, and then mixed (primary mixing). The amount of the binder was represented by parts by weight based on the total amount of 100 parts by weight of the iron-based powder, the powder for an alloy and the machinability improving powder shown in Table 10.

Then, zinc stearate was further added as the binder in the amount shown in Table 10 to the primary mixture, and the resultant mixture was put in a heated blender and sufficiently mixed to form a mixture. The thus-formed mixture was heated to the temperature shown in Table 10 under mixing to form a secondary mixture.

Then, the secondary mixture was cooled to 85° C. or less under mixing. Furthermore, the secondary mixture was cooled to 40° C., and the free lubricant of the type shown in Table 10 was added to the secondary mixture. The amount of the lubricant added was as shown in Table 10. The resultant mixture was then uniformly mixed (tertiary mixing), and discharged from the heat blender to form an iron-based mixed powder. The symbols and types of the lubricants other than a thermoplastic resin powder, zinc stearate and lithium stearate added in tertiary mixing were the same as shown in Table 7 of Example 6. The symbols, the types, the compositions, the polymerization methods, the primary particle diameters, the agglomerated particle diameters and the molecular weights of the thermoplastic resin powders used in tertiary mixing were the same as shown in Table 8 of Example 6.

The iron-based mixed powders used included an iron-based mixed powder (No. 7-12) containing no machinability improving powder, and an iron-based mixed powder (No. 7-15) containing MnS as the machinability improving powder (Conventional Example). Also, in a comparative example (iron-based mixed powder No. 7-14), the mixture was mixed at room temperature (RT) for 30 minutes with the V-blender without using the binder, and in an inventive example (iron-based mixed powder No. 7-16), the binder (PVB) was dissolved in an organic solvent (toluene), and then evaporated to fix the powder for an alloy and the machinability improving powder to the iron-based powder.

Each of the iron-based mixed powders was examined with respect to the degrees of adhesion of the graphite powder, and the alkali earth metal fluoride powder in the same manner as Example 6.

Then, a die(mold) was filled with each of the thus-formed iron-based mixed powders, and pressing was carried out at compacting pressure of 480 MPa to a disk-shaped specimen green compact of outer diameter 60 mm×height 10 mm for a drilling test, and a rectangular green compact of 10×10×55 mm in the same manner as Example 6.

The density of the rectangular green compact was measured by the same Archimedes method as Example 6.

The specimen green compacts were sintered at 1130° C. for 20 minutes in the RX gas atmosphere by using the mesh belt furnace to form sintered compacts.

Each of the sintered compacts (specimens) was subjected to the drilling test under the conditions including a revolution speed of 10000 rpm and a feed of 0.012 mm/rev to determine the number of bores in the same manner as Example 6.

The results are shown in Table 11.

TABLE 10

| Iron-based mixed powder No. | Powder for alloy**** % by mass: Copper powder | Powder for alloy**** % by mass: Graphite powder | Powder for improving machinability: Type | Powder for improving machinability: Content**** % by mass | Powder for improving machinability: Particle diameter μm | Secondary mixing heating temperature ° C. | Binder: Oleic acid parts by weight | Binder: Spindle oil parts by weight | Binder: Turbine oil parts by weight |
|---|---|---|---|---|---|---|---|---|---|
| 7-1 | 2.0 | 0.75 | $CaF_2$ | 0.15 | 10 | 125 | 0.07 | — | — |
| 7-2 | 2.0 | 0.75 | $CaF_2$ | 0.30 | 15 | 120 | 0.10 | — | — |
| 7-3 | 2.0 | 0.75 | $CaF_2$ | 0.40 | 25 | 115 | 0.12 | — | — |
| 7-4 | 2.0 | 0.75 | $CaF_2$ | 0.50 | 10 | 130 | — | 0.07 | — |
| 7-5 | 2.0 | 0.75 | $CaF_2$ | 0.65 | 35 | 140 | — | 0.10 | 0.15 |
| 7-6 | 2.0 | 0.75 | $MgF_2$ | 0.30 | 25 | 120 | — | — | 0.20 |
| 7-7 | 2.0 | 0.75 | $MgF_2$ | 0.50 | 20 | 130 | — | 0.05 | — |
| 7-8 | 2.0 | 0.75 | $SrF_2$ | 0.30 | 15 | 120 | — | 0.07 | — |
| 7-9 | 2.0 | 0.75 | $SrF_2$ | 0.50 | 20 | 110 | — | 0.10 | 0.15 |
| 7-10 | 2.0 | 0.75 | $BaF_2$ | 0.30 | 26 | 120 | — | — | 0.20 |
| 7-11 | 2.0 | 0.75 | $BaF_2$ | 0.50 | 30 | 130 | — | 0.06 | — |
| 7-12 | 2.0 | 0.75 | — | — | — | 110 | 0.08 | — | — |
| 7-13 | 2.0 | 0.75 | $CaF_2$ | 0.90 | 25 | 130 | — | 0.10 | — |
| 7-14 | 2.0 | 0.75 | $CaF_2$ | 0.50 | 10 | RT* | — | — | — |
| 7-15 | 2.0 | 0.75 | MnS | 0.50 | 24 | 120 | — | 0.12 | — |
| 7-16 | 2 | 0.75 | $CaF_2$ | 0.40 | 25 | — | — | — | — |

| Iron-based mixed powder No. | Binder: Zinc stearate parts by weight | Binder: Total***** parts by weight | Free lubricant (Type: Content (parts by weight)): Thermoplastic resin powder**: Type | Thermoplastic resin powder**: Content | Zinc stearate | Lithium stearate | Total***** parts by weight | Type:*** Content***** parts by weight | Total***** parts by weight |
|---|---|---|---|---|---|---|---|---|---|
| 7-1 | 0.30 | 0.37 | — | — | 0.40 | — | 0.40 | — | 0.40 |
| 7-2 | 0.50 | 0.60 | — | — | 0.25 | — | 0.25 | — | 0.25 |
| 7-3 | 0.40 | 0.52 | — | — | 0.30 | — | 0.30 | — | 0.30 |
| 7-4 | 0.35 | 0.42 | C | 0.15 | — | 0.05 | 0.20 | f: 0.60 | 0.80 |
| 7-5 | 0.40 | 0.65 | A | 0.20 | — | — | 0.20 | c: 0.20 | 0.40 |
| 7-6 | 0.70 | 0.90 | B | 0.25 | — | — | 0.25 | a: 0.05, d: 0.15 | 0.45 |
| 7-7 | 0.38 | 0.43 | D | 0.30 | — | 0.10 | 0.40 | d: 0.15 | 0.55 |
| 7-8 | 0.35 | 0.42 | C | 0.15 | — | 0.05 | 0.20 | f: 0.60 | 0.80 |
| 7-9 | 0.40 | 0.65 | E | 0.20 | — | — | 0.20 | c: 0.20 | 0.40 |
| 7-10 | 0.70 | 0.90 | F | 0.25 | — | — | 0.25 | d: 0.15 | 0.40 |
| 7-11 | 0.38 | 0.44 | G | 0.30 | — | 0.10 | 0.40 | d: 0.15 | 0.55 |
| 7-12 | 0.40 | 0.48 | F | 0.20 | — | — | 0.20 | e: 0.15 | 0.35 |
| 7-13 | 0.35 | 0.45 | — | — | — | 0.30 | 0.30 | — | 0.30 |

TABLE 10-continued

| | | | | | | | | | |
|---|---|---|---|---|---|---|---|---|---|
| 7-14 | — | — | — | — | — | — | — | e: 0.75 | 0.75 |
| 7-15 | 0.35 | 0.47 | G | 0.15 | — | — | 0.15 | b: 0.30, d: 0.05 | 0.50 |
| 7-16 | — | ******PVB 0.09 | — | — | 0.75 | — | 0.75 | — | 0.75 |

*Mixing with a V-shaped blender
**Refer to Table 8
***Refer to Table 7
****Based on the total of (iron-based powder + powder for alloy + powder for improving machinability)
*****Based on the total of 100 parts by weight of (iron-based powder + powder for alloy + powder for improving machinability)
******Polyvinyl alcohol of 0.09 parts by weight

TABLE 11

| | Degree of adhesion | | | Properties of | | |
|---|---|---|---|---|---|---|
| Iron-based mixed powder No. | Graphite powder % | Powder for improving machinability* % | Pressed product Density $Mg/m^3$ | sintered compact Machinability Number of bores | Appearance of sintered compact | Remarks |
| 7-1 | 83 | 86 | 6.88 | 515 | Good | Example of this invention |
| 7-2 | 82 | 80 | 6.85 | 610 | Good | Example of this invention |
| 7-3 | 83 | 74 | 6.84 | 760 | Good | Example of this invention |
| 7-4 | 82 | 83 | 6.84 | 860 | Good | Example of this invention |
| 7-5 | 83 | 71 | 6.82 | 810 | Good | Example of this invention |
| 7-6 | 81 | 78 | 6.84 | 440 | Good | Example of this invention |
| 7-7 | 83 | 80 | 6.83 | 460 | Good | Example of this invention |
| 7-8 | 85 | 81 | 6.85 | 505 | Good | Example of this invention |
| 7-9 | 84 | 81 | 6.83 | 530 | Good | Example of this invention |
| 7-10 | 83 | 76 | 6.85 | 480 | Good | Example of this invention |
| 7-11 | 81 | 72 | 6.82 | 510 | Good | Example of this invention |
| 7-12 | 83 | — | 6.86 | 3 | Good | Comparative Example |
| 7-13 | 81 | 72 | 6.74 | 20 | Good | Example of this invention |
| 7-14 | 25 | 32 | 6.87 | 230 | Good | Comparative Example |
| 7-15 | 83 | — | 6.83 | 810 | Adhesion of soot | Conventional Example |
| 7-16 | 75 | 73 | 6.82 | 715 | Good | Example of this invention |

*Fluoride of alkali earth metal

In all examples of this invention, especially examples satisfying preferable conditions, the green compacts have a high density, the degrees of adhesion of the graphite powder and the machinability improving powder are high, and the number of bores are large. Therefore, sintered compacts having excellent machinability can be formed, and iron-based mixed powders have excellent properties for powder metallurgy.

On the other hand, in the comparative examples out of the range of the invention, the degrees of adhesion of the graphite powder and the machinability improving powder are low to deteriorate machinability. Also, in the iron-based mixed powder (No. 7-15) (Conventional Example) containing the S-containing machinability improving powder, 110 defects (sooting) were observed in the appearance of the sintered compact.

The composition of the water-atomized iron powder (KIP®301A) was substantially the same as the water-atomized iron powder (symbol a in Table 1) of Example 1. The compositions of the iron-based mixed powders and the sintered compacts exhibited the same tendency as Example 1.

As described above, the invention can improve machinability without deteriorating the mechanical properties of a sintered compact. Furthermore, the invention can form a machinability improving powder not containing S (sulfur), thereby permitting the production of a sintered compact without causing contamination with S in a sintering furnace (a heating device, a conveyor belt, etc.) and an adverse effect on the sintered compact. Therefore, the invention exhibits a significant industrial effect.

What is claimed is:

1. An iron-based mixed powder for powder metallurgy comprising an iron-based powder, an alloying powder, a machinability improving powder containing a phosphate compound of an alkali earth metal, and a lubricant.

2. The iron-based mixed powder according to claim 1, wherein phosphate compound of an alkali earth metal comprises calcium phosphate compound.

3. The iron-based mixed powder according to claim 2, wherein the phosphate compound of an alkali earth metal comprises hydroxyapatite.

4. The iron-based mixed powder according to claim 3, wherein the machinability improving powder consists of hydroxyapatite.

5. The iron-based mixed powder according to claim 3, wherein the hydroxyapatite has crystallites size of over about 200 Å.

6. The iron-based mixed powder according to claim 2, wherein the machinability improving powder consists of calcium phosphate compound.

7. The iron-based mixed powder according to claim 2, wherein the calcium phosphate compound is selected from the group consisting of tricalcium phosphate, calcium monohydrogen phosphate, calcium dihydrogen phosphate, hydroxyapatite and mixtures thereof.

8. The iron-based mixed powder according to claim 2, wherein the total content of the calcium phosphate compound is about 0.02 to about 0.39% by mass in terms of Ca based on the total amount of the iron-based powder, the alloying powder and the machinability improving powder.

9. The iron-based mixed powder according to claim 1, wherein the machinability improving powder further comprises an alkali earth metal fluoride.

10. The iron-based mixed powder according to claim 9, wherein the phosphate compound of an alkali earth metal comprises calcium phosphate compound and the alkali earth metal fluoride comprises calcium fluoride.

11. The iron-based mixed powder according to claim 10, wherein the machinability improving powder is consists of calcium phosphate compound and calcium fluoride.

12. The iron-based mixed powder according to claim 10, wherein the calcium fluoride and the calcium phosphate compound are contained in a ratio (content of calcium fluoride)/(content of calcium phosphate compound) of about 0.8 or more in terms of Ca.

13. The iron-based mixed powder according to claim 10, wherein the calcium phosphate compound is selected from the group consisting of tricalcium phosphate, calcium monohydrogen phosphate, calcium dihydrogen phosphate, hydroxyapatite and mixtures thereof.

14. The iron-based mixed powder according to claim 10, wherein the total content of the calcium phosphate compound and calcium fluoride is about 0.02 to about 0.39% by mass in terms of Ca based on the total amount of the iron-based powder, the alloying powder and the machinability improving powder.

15. The iron-based mixed powder according to claim 1, wherein at least one of the alloying powder and the machinability improving powder is fixed to surfaces of some or all of the iron-based powder with a binder.

16. An iron-based mixed powder for powder metallurgy comprising an iron-based powder, an alloying powder containing graphite powder, a machinability improving powder, a binder, and a lubricant, wherein the machinability improving powder contains an alkali earth metal fluoride powder, and the graphite powder and the alkali earth metal fluoride powder are mainly fixed to concave portions of surfaces of the iron-based powder with the binder.

17. The iron-based mixed powder according to claim 16, wherein the machinability improving powder consists of an alkali earth metal fluoride powder.

18. The iron-based mixed powder according to claim 16, wherein the lubricant is a free lubricant in a free state.

19. The iron-based mixed powder according to claim 16, wherein the content of the alkali earth metal fluoride powder is about 0.1 to about 0.7% by mass based on the total amount of the iron-based powder, the alloying powder, and the machinability improving powder.

20. The iron-based mixed powder according to claim 16, wherein the alkali earth metal fluoride powder is selected from the group consisting of calcium fluoride, magnesium fluoride, strontium fluoride, barium fluoride and mixtures thereof.

* * * * *

UNITED STATES PATENT AND TRADEMARK OFFICE

CERTIFICATE OF CORRECTION

PATENT NO. : 6,648,941 B2
DATED : November 18, 2003
INVENTOR(S) : Uenosono et al It is certified that error appears in the above-identified patent and that said Letters Patent is hereby corrected as shown below:

Column 20,
Table 1-1, at "Mixed powder No. 1-3", at the subheading "Rate of dimensional change %", please change ".015" to -- 0.15 --.

Signed and Sealed this

Seventh Day of September, 2004

JON W. DUDAS
*Director of the United States Patent and Trademark Office*